US012005367B2

(12) United States Patent
Green et al.

(10) Patent No.: US 12,005,367 B2
(45) Date of Patent: Jun. 11, 2024

(54) IMMERSION PLATFORM

(71) Applicant: Ellie DAO, Mountain View, CA (US)

(72) Inventors: David Green, Westminster, CA (US); Jason Glickman, Princeton, NJ (US)

(73) Assignee: Jason Glickman, Princeton, NJ (US)

( * ) Notice: Subject to any disclaimer, the term of this patent is extended or adjusted under 35 U.S.C. 154(b) by 0 days.

(21) Appl. No.: 17/979,077

(22) Filed: Nov. 2, 2022

(65) Prior Publication Data

US 2023/0294006 A1 Sep. 21, 2023

Related U.S. Application Data

(63) Continuation of application No. 17/696,929, filed on Mar. 17, 2022, now Pat. No. 11,511,206.

(51) Int. Cl.

| | |
|---|---|
| ***A63G 31/16*** | (2006.01) |
| ***A63G 31/00*** | (2006.01) |
| ***E04B 1/32*** | (2006.01) |
| ***E04H 4/00*** | (2006.01) |
| *A63J 5/00* | (2006.01) |
| *A63J 5/04* | (2006.01) |

(52) U.S. Cl.

CPC ..... *A63G 31/00* (2013.01); *E04B 1/3211* (2013.01); *E04H 4/0006* (2013.01); *A63J 2005/003* (2013.01); *A63J 2005/006* (2013.01); *A63J 2005/008* (2013.01); *A63J 5/04* (2013.01); *E04B 2001/3235* (2013.01)

(58) Field of Classification Search

CPC ..... A63G 31/00; A63G 31/16; A63G 31/007; E04B 1/3211; E04B 4/006

USPC ..... 472/13, 59, 60, 61, 117, 128

See application file for complete search history.

(56) References Cited

U.S. PATENT DOCUMENTS

| | | | | |
|---|---|---|---|---|
| 6,113,500 | A | 9/2000 | Francis et al. | |
| 11,478,718 | B1 * | 10/2022 | Laffin | A63G 31/02 |
| 2017/0225084 | A1 | 8/2017 | Snyder et al. | |
| 2019/0176026 | A1 * | 6/2019 | Briggs | A63F 13/21 |
| 2019/0270029 | A1 | 9/2019 | Matson | |

OTHER PUBLICATIONS

PCT/US222/048655 International Search Report and Written Opinion. dated Dec. 13, 2022.

* cited by examiner

*Primary Examiner* — Kien T Nguyen

(74) *Attorney, Agent, or Firm* — Joseph E. Maenner; Maenner & Associates, LLC

(57) ABSTRACT

An immersion platform includes a dome configured to display a predetermined scene, wherein the dome includes an outer perimeter. A controller is configured to display the predetermined scene on the dome and to activate the plurality of accessories according to a predetermined timeline. A camera is configured to allow a user to stream the user to other platforms while the user is using the platform.

18 Claims, 21 Drawing Sheets

IMMERSION PLATFORM

BACKGROUND OF THE INVENTION

Field of the Invention

The invention relates to a modular immersion device that provides a 360 degree view of an artificially generated environment that can be used for meditation, relaxation, entertainment, and other therapeutic uses.

Description of the Related Art

Immersion devices are used to artificially simulate a different environment than the environment in which a user is actually present. Typical immersion devices are preconfigured and cannot be altered or specified by the user.

It would be beneficial to provide a modular immersion device that can be configured according to a user's wants or needs.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is An immersion platform that includes a dome configured to display a predetermined scene. The dome includes an outer perimeter. A plurality of sensory accessories are configured to stimulate at least one sense of a user. The sensory accessories include at least one of an air blower module, a lighting module, an audio module, a scent module, a haptic vibration module, a temperature module, a floor module, and brain stimulation features. A controller is configured to display the predetermined scene on the dome and to activate the plurality of accessories according to a predetermined timeline.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
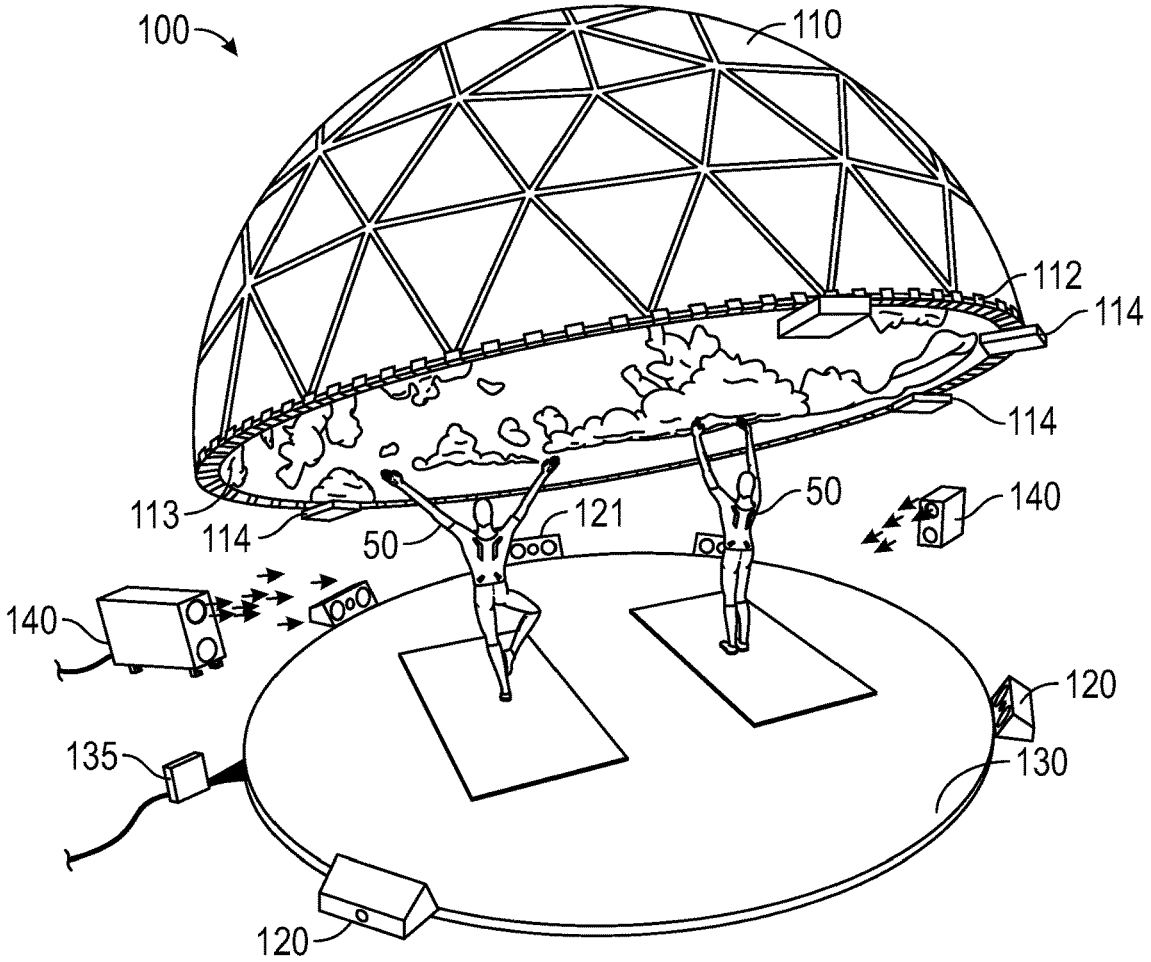
FIG. 1 is perspective view of an immersion platform according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention provides an immersion simulator 100 that can simulate different environments that can be used for meditation, relaxation, entertainment, and other therapeutic uses. The inventive system can be used with yoga, meditative music/sounds, or other relaxation formats. The inventive system is not a virtual reality simulator, but is instead an artificially generated environment.

Referring to the Figures, FIG. 1 shows an exemplary embodiment of immersion platform 100 according to the present invention. The platform 100 includes a dome 110 that is configured to display a predetermined scene. As shown in FIG. 1, platform 100 with dome 110 can be configured as a workout studio. Dome 110 can have a 5 meter diameter that encloses the users in the visual experience provided by dome 110. Alternatively, a smaller dome 110, such as a dome 110 having a 3 meter diameter, can be used. Still alternatively, a larger dome 110, such as a dome 110 having a 10 meter diameter, can be used and can serve as a projection screen for a movie theater-type environment.

Dome 110 is in a tilted position shown in FIG. 1. In an exemplary embodiment, dome 110 is positioned to the tilted position at an angle between about 10 degrees and about 45 degrees and, in an alternative exemplary embodiment, dome 110 is positioned to the tilted position at an angle of about 25 degrees. As shown in FIG. 1, dome 110 is tilted to a 25° angle in order to enhance the immersive experience for the users 50 standing up.

Although not shown, a motorized frame can be provided for dome 110, lifting the back and lowering the front portions of dome 110 simultaneously. It is noted that the height of the medium rim level should be altered, depending upon the tilt angle. This relates to user access to the floor 60 as well as the average user's eye level in relation to the dome 110 during the activity.

Alternatively, dome 110 can be provided in the upright position for a user 50 lying down and gazing straight up. In this configuration, as the user will be looking straight upwards while they lie on their back, therefore not having a tilt to dome 110 will provide the most immersive display for the user 50.

Figure 1A:
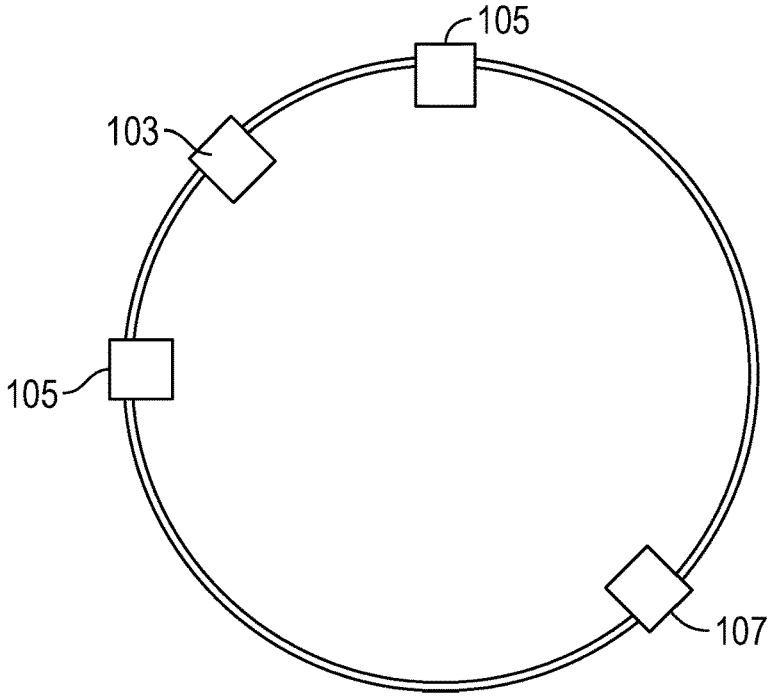
FIG. 1A is a schematic drawing of an exemplary location of video projectors in the immersion platform of FIG. 1.

Dome 110 is a 360 degree projection dome that enables user 50 to be enveloped in a visual experience without the need for any type of head-mounted display, such as is typically used in virtual reality. Visual projections onto the inside screen 113 of dome 110 can include four (4) digital light processing ("DLP") projectors, as shown schematically in FIG. 1A, each with a 3K display resolution, with three (3) front projectors, with a central projector 103 aligned with a user's direct view and the remaining two (2) projectors 105 at 45 degree angles around an outer perimeter of dome 110. The fourth projector 107 is located at 180 degrees around the outer perimeter of dome 110 from the central projector 103. Those skilled in the art understand that mapping software is required to run projection mapped visualizations across dome 112, seamlessly interlacing the images from each projector 103, 105, 107.

Dome 112 is mounted on a lightweight frame that enables both floor mounting of dome 112, as well as ceiling mounting of dome 112. In an exemplary embodiment, dome 112 can weigh approximately 150 kg.

Figure 2:
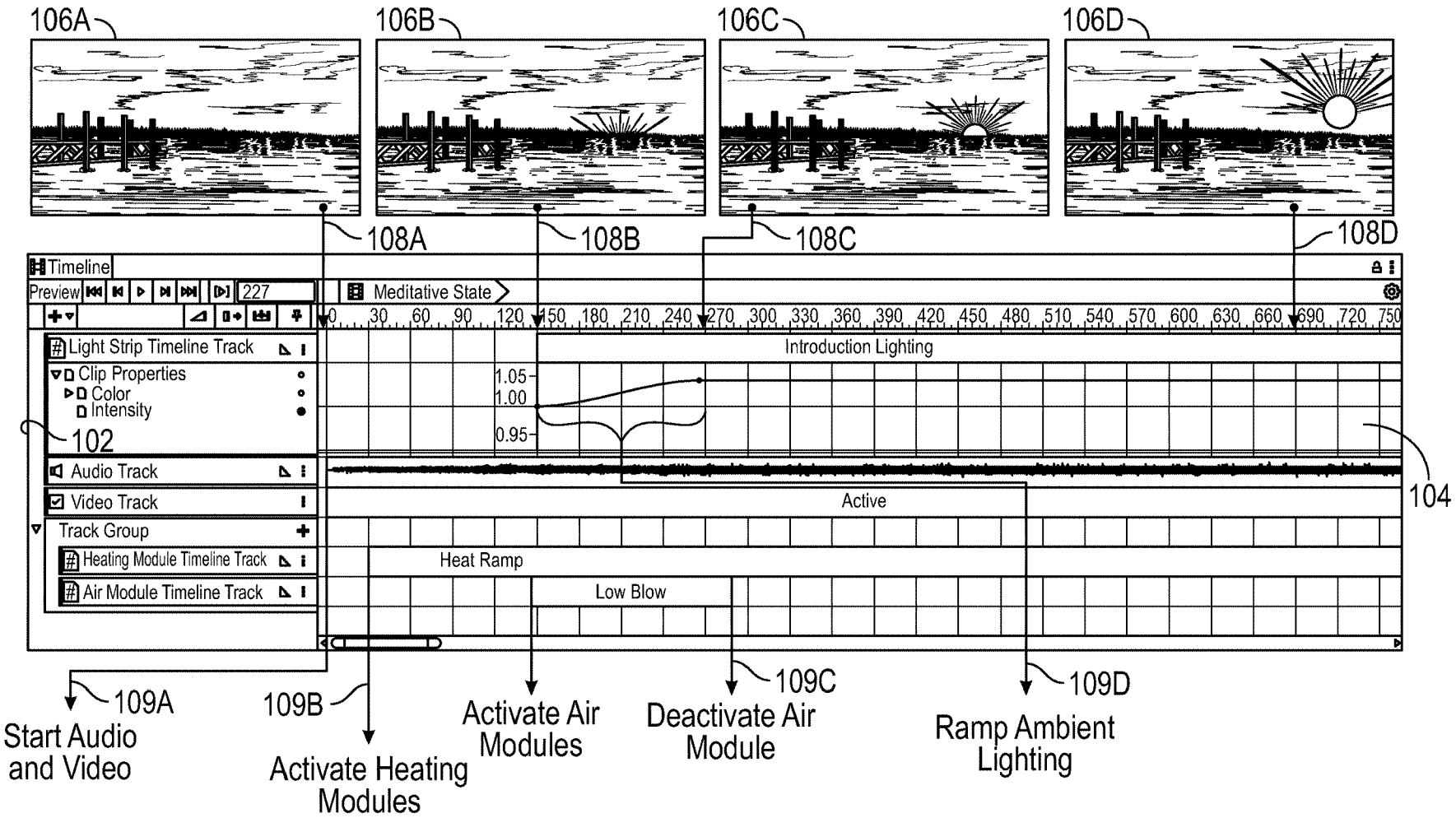
FIG. 2 is a front elevational view of a controller with timeline for operating the immersion platform of FIG. 1.

A controller 102 (shown in FIG. 2), configured to display the predetermined scene on the dome 110 and to activate the plurality of accessories according to a predetermined timeline 104, can be electronically coupled to dome 110 to control the tilt of dome 110. Controller 102 can be programmed with a timeline and a scenario to project video or still pictures onto the underside of dome 110. Additionally, timeline 102 is adjustable to meet the needs or desires of user 50. Controller 102 displays timeline 104 to which features of platform 100 can be timed to provide the desired immersion experience.

Timeline 104 ties all the components of platform 100 together. Whenever a user 50 runs a session (meditation, location experience, etc.), the controller 102 will control when each component will activate and the set of parameters for that component to run. A timeline editor is used to perform this level of timed component control. By way of example only, controller 102 is used to feed the visuals from the four (4) video projectors 103, 105, 107 at the correct timing corresponding to timeline 104.

Timeline editors can often be seen in video or music editing software to place video and audio clips in sequence and manage their transitions. For platform 100, this sequencing is used for not only video and audio, but also to control other sensory devices such as air blowers and haptics, as will be described in detail later herein.

Screen shots 106A, 106B, 106C, 106D show a time lapse from a video showing a sun rise, with each screenshot correlated to a specific time along timeline 104 with arrows 108A, 10B, 108C, 108D, respectively. Corresponding tracks for other features such as start of audio/video (arrow 109A), activation and operation of heating modules (arrow 109B), activation/deactivation of air blowers (arrow 109C), and ramping up of ambient lighting (arrow 109D), are shown on timeline 104.

Figure 3:
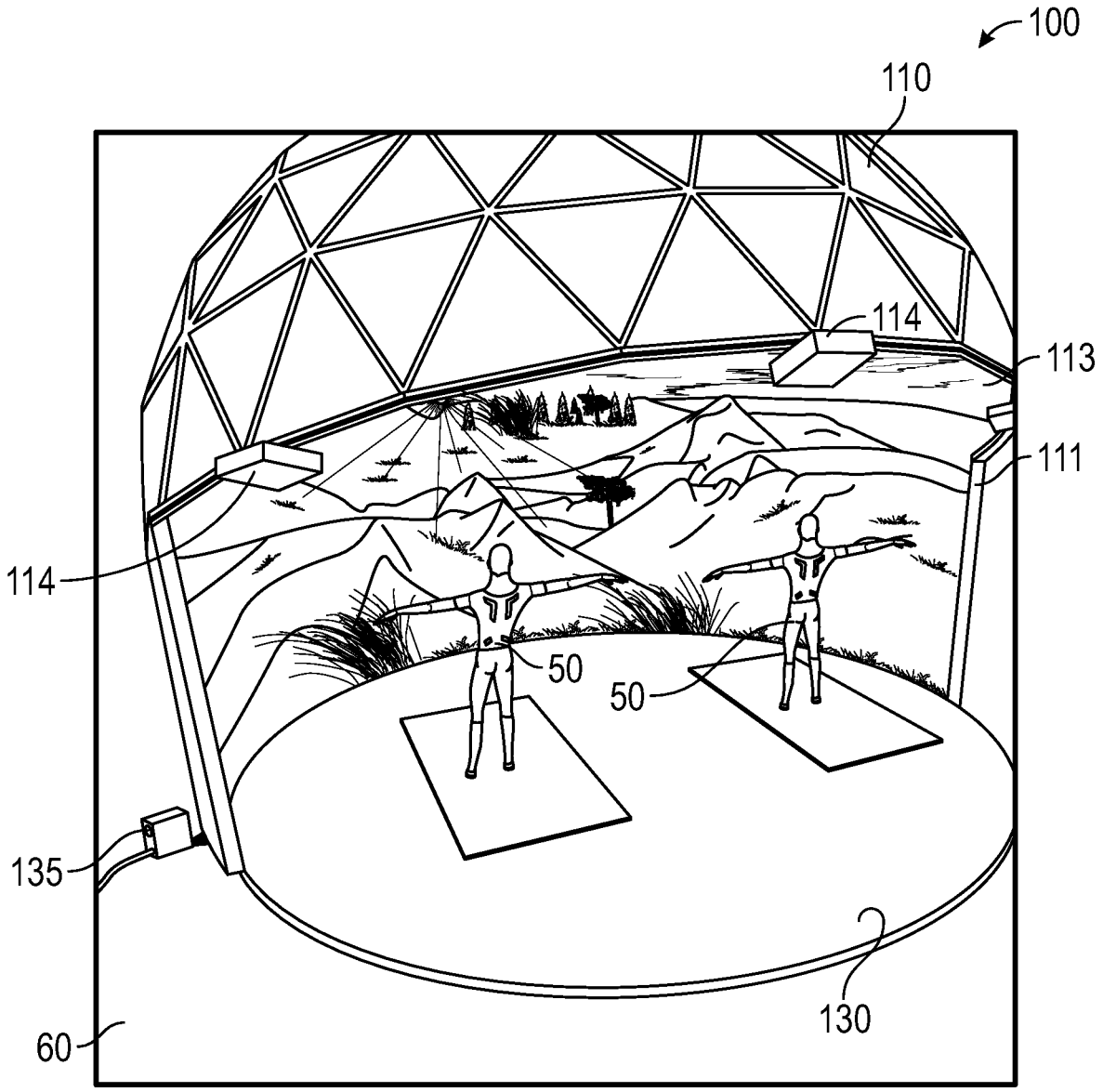
FIG. 3 is a perspective view of an alternative embodiment of an immersion platform according to the present invention.
Figure 4:
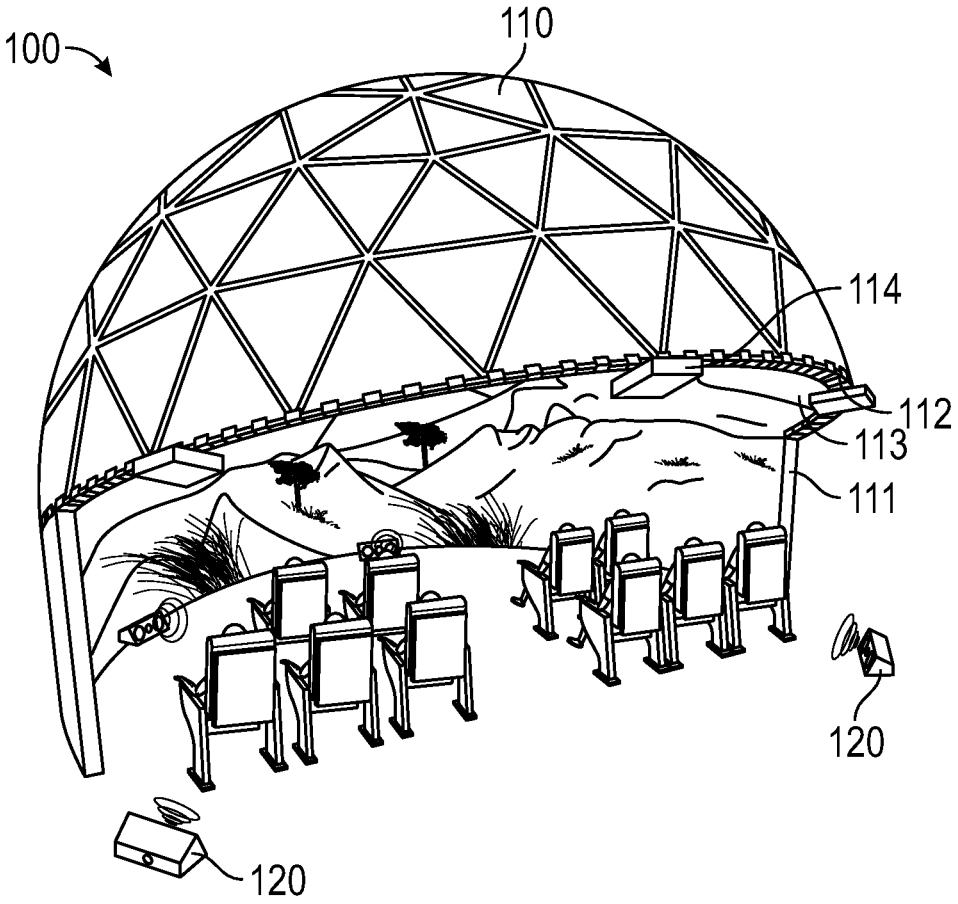
FIG. 4 is a perspective view of another alternative embodiment of an immersion platform according to the present invention.

Optionally, as shown in FIG. 3, a skirt 111 can be provided between dome 110 and a floor 60 to enhance the visual experience provided by a selected video. The video can be projected onto both dome 110 and skirt 111 to further mark user 50 "feel" like they are actually in the location being displayed in the projected video. Skirt 111 is especially beneficial when using the 10 meter dome 110 to enhance the theater-like atmosphere, as shown in FIG. 4. Skirt 111 avoids casting shadows from the users by using a rear projection system (not shown). If skirt 111 is provided, the tilt of dome 110 is not adjustable. With skirt 111 in place, dome 110 would be fixed to avoid changes to the rear projected medium, which is sensitive to adjustments.

Figure 3A:
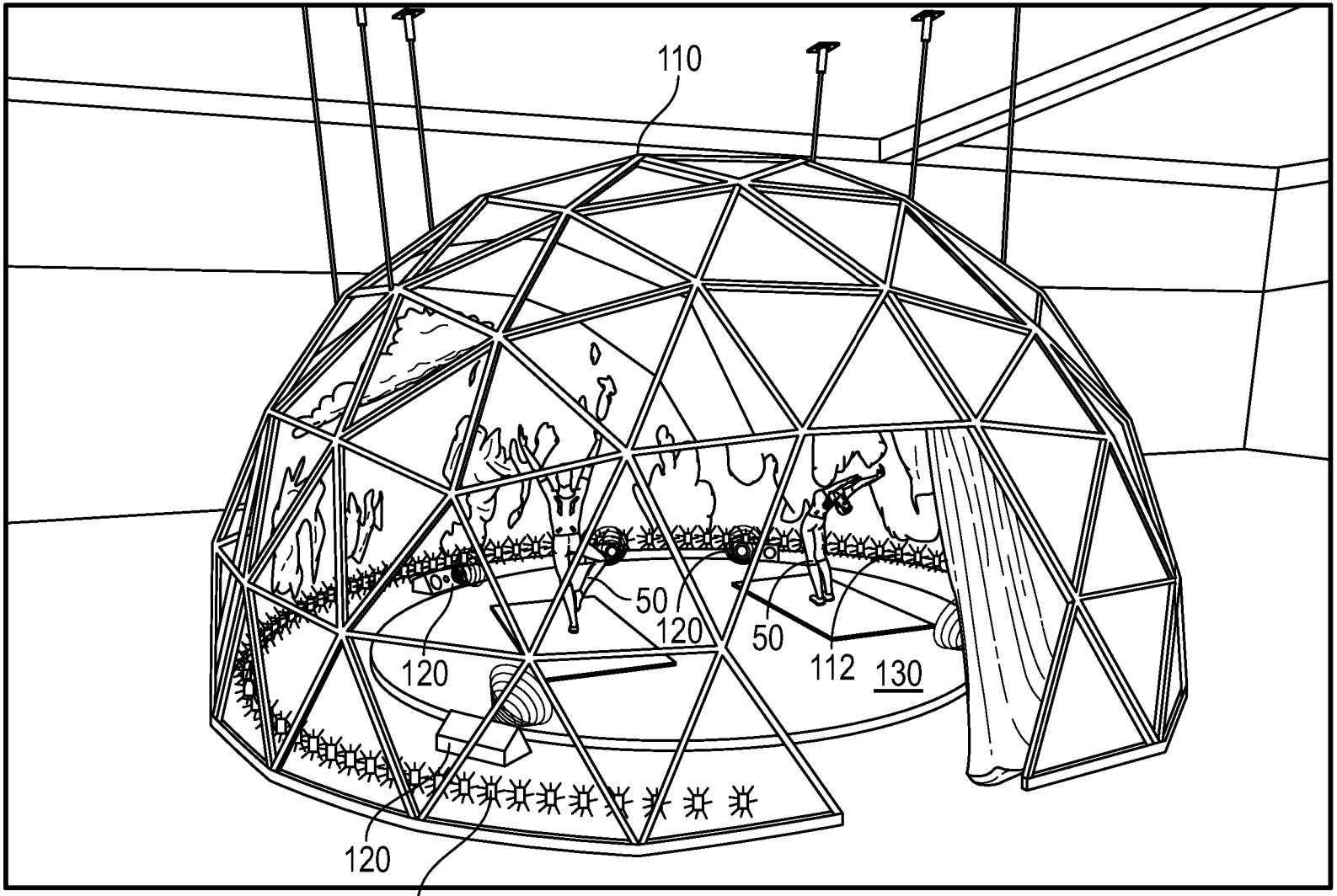
FIG. 3A shows a cut-away perspective view of the dome of FIG. 3 without a skirt and fully lowered to the floor.
Figure 4A:
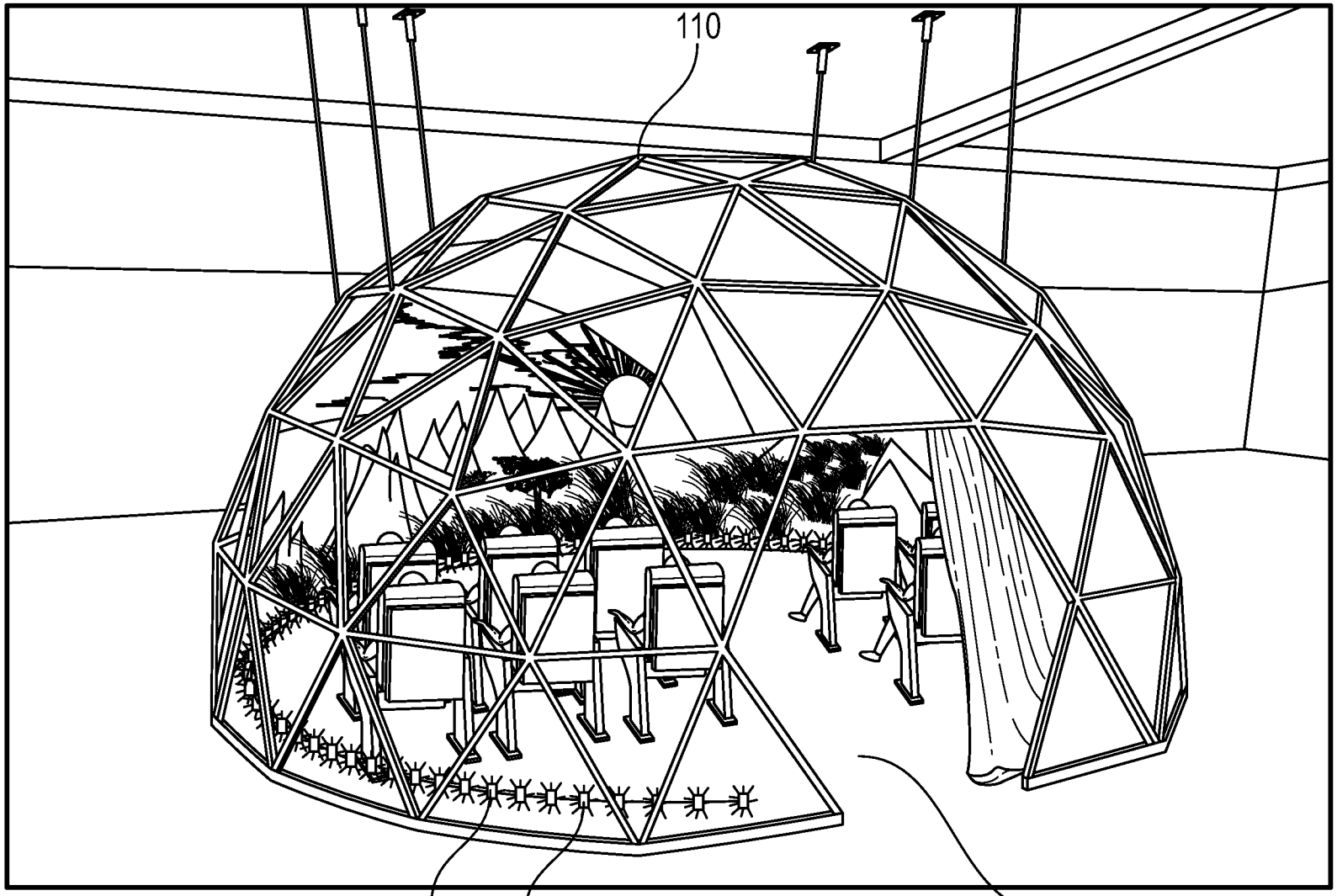
FIG. 4A shows a cut-away perspective view of the dome of FIG. 4 fully lowered to the floor.

FIGS. 3A and 4A each shows dome 110 without skirt 111, and with dome 110 sitting directly onto the floor.

A plurality of sensory accessories can be configured with dome 110 to stimulate at least one sense of a user. The sensory accessories can include at least one of a lighting module, an air blower module, a temperature module, an audio module, a scent module, a temperature module, and a pool module. In addition to controlling tilt of dome 110, controller 102 can be configured to display a predetermined scene on the dome 110 and to activate the plurality of accessories according to timeline 104.

The accessories, or modules, are considered to be modular and platform 100 can be adapted to suit the needs of the user 50 and/or the installation environment. No hardware component or module is reliant on another and no hardware parameters have a strict set of rules under which to operate. Designs are considered in terms of impact over implementation in order for the user 50 to adapt to such needs as installation and transportation require.

Referring back to FIG. 1, lights 112 can be added around a perimeter of dome 110. Lights 112 can be controlled by controller 102 to adjust the brightness/dimness, as well as color of lights 112, depending on the timeline and scenario programmed into controller 102. Some of lights 112 can be pointed up to shine onto dome 110, while other lights 112 can be pointed downward to floor 60. Lights 112 can be operated in a synchronous manner to extend the visual display beyond dome 110 with responsive peripheral lighting. Lights 112 wrapping around the perimeter of dome 110 extend the display using an effect seen in many backlighting systems.

Optionally, lights 112 can be used as a visual replacement when sessions with platform 100 contain only an audio source or as ambient lighting when user 50 arrives and departs from a session with platform 100. Lights 112 can be light emitting diodes (LEDs) and can include high energy visible light to help to eliminate bacteria, as well as ultraviolet light to provide a tanning experience while the user 50 sits or exercises under dome 110.

Different size domes 110 (e.g. 3 meter, 5 meter, 10 meter) require different amounts of lights 112, so a zonal system is used to describe lights 112 to controller 102, with an intermediate step within the light hardware interface driver to determine which lights 112 refer to which zone. This zonal system means that the number of lights 112 for various configurations does not matter to the controller software, which is only concerned with processing zone colors and intensities to generate a desired visual effect. By way of example only for a system with 100 zones and 1500 addressable lights 112 around the perimeter of dome 110, every 15 lights reference a single zone. Alternatively, having 2000 zones with only 1000 addressable lights, every other zone is skipped, with the non-skipped zones each having a single light 112.

Speakers 114 can be mounted to dome 110 around the perimeter of dome 110 and can be programmed by controller 102 to generate different sounds to simulate, not just a stereo environment, but also a three-dimensional surround sound audio environment. Additionally, speakers 120 can be located on floor 60 to enhance the audio experience for user 50. Similar to speakers 114, speakers 120 can be programmed by controller 102 to generate different sounds to simulate, not just a stereo environment, but also a three-dimensional surround sound audio environment.

Figure 5:
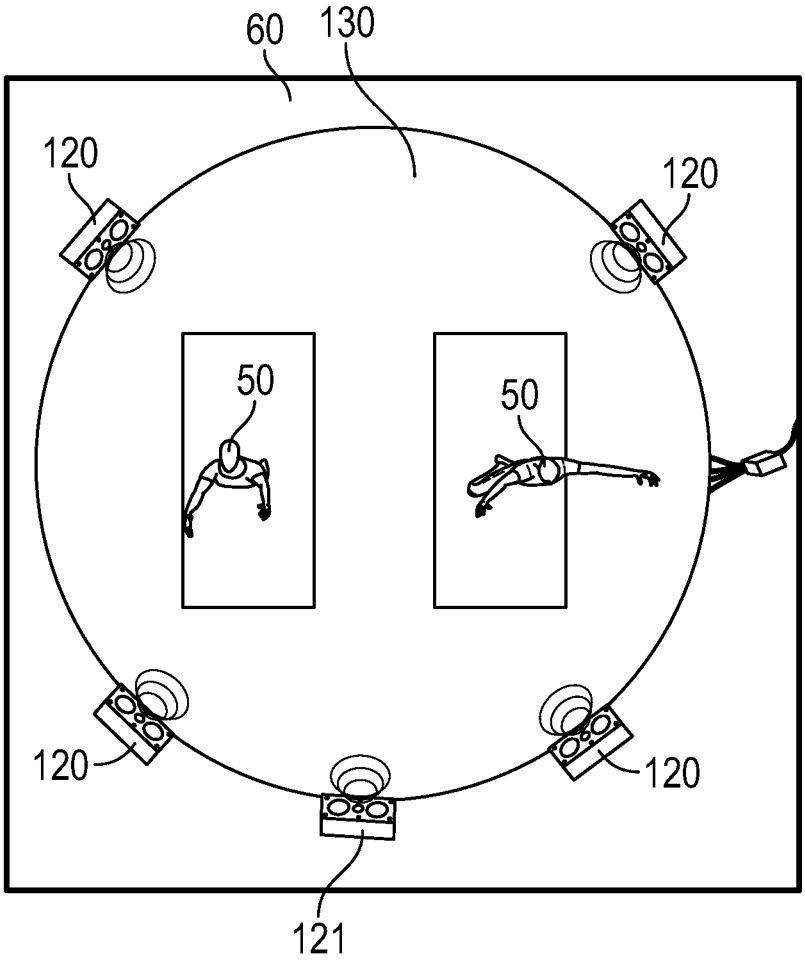
FIG. 5 is a top plan view of a speaker arrangement for use with any embodiment of the immersion platform according to the present invention.

Referring to FIG. 5, four speakers 120 can be placed on floor 60, spaced 90 degrees around a periphery from each adjacent speaker 220, while a fifth speaker 121 can be placed centrally between two adjacent forward speakers 120.

Alternatively, headphones can be provided for each user 50 to provide binaural audio. Such headphones are synchronized by controller 102 to provide the audio at predetermined times along timeline 104.

Optionally, a dedicated floor 130 can be provided to lay over existing floor 60. Floor 130 is configured for placement beneath the dome 110. Floor 130 can be 5 meters in diameter and, depending on the anticipated use of platform 100, has a capacity of up to 4 users.

Figure 7:
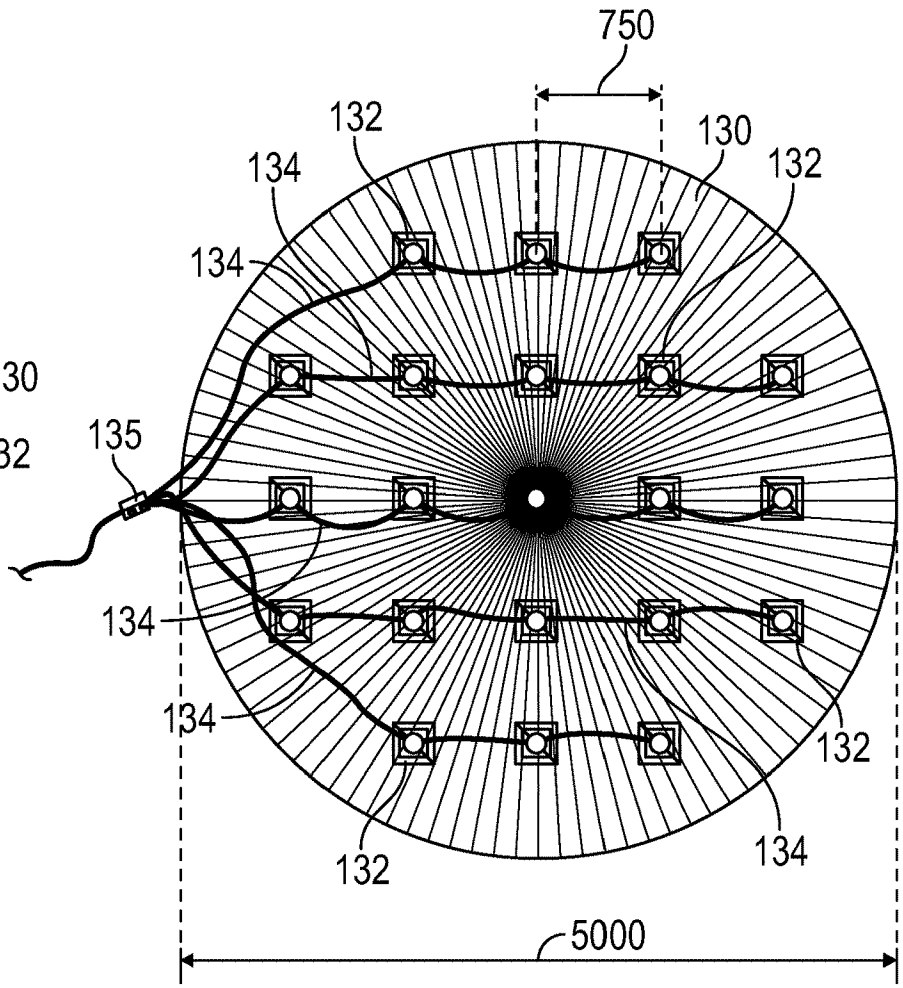
FIG. 7 is a top plan view of an exemplary connection of the vibrators of FIG. 6.
Figure 6:
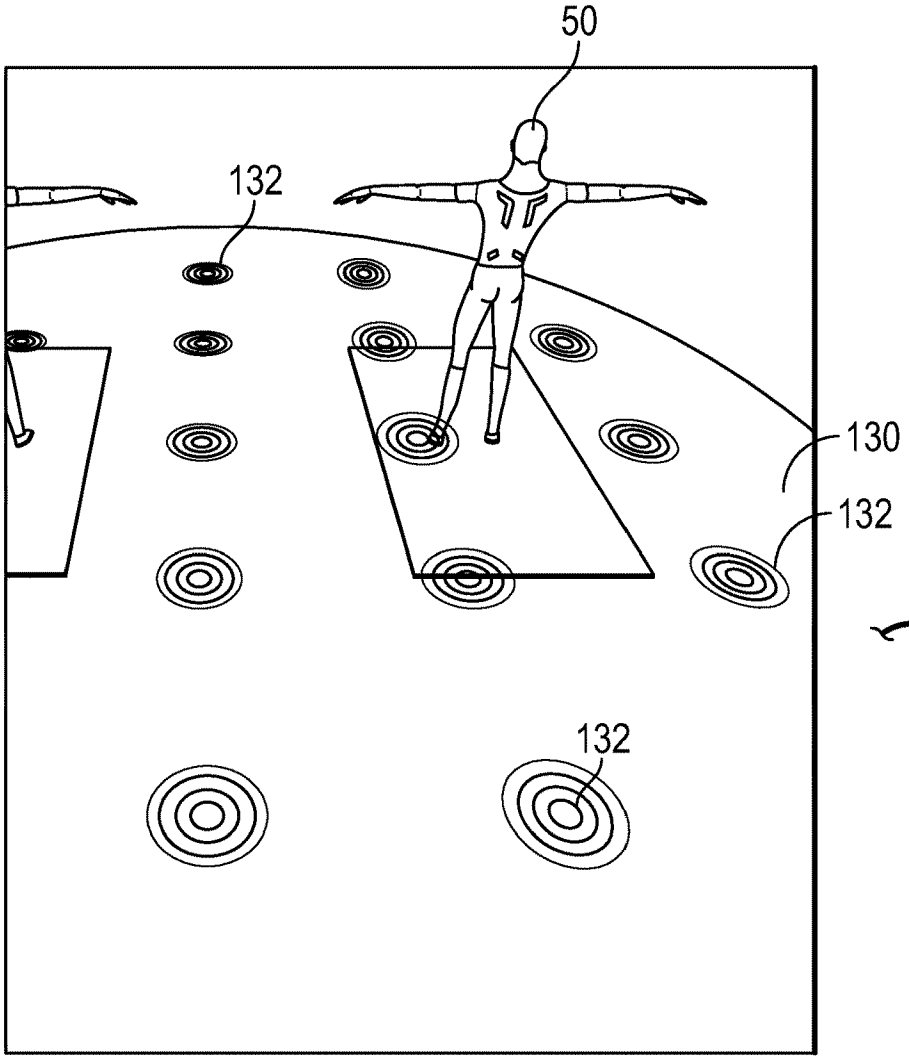
FIG. 6 is a perspective view of a floor with vibrators used with any embodiment of the immersion platform according to the present invention.

As shown in FIGS. 6 and 7, a plurality of vibrators 132 can be embedded in the floor 130 in a matrix to generate vibrations that provide haptics to enhance the user experience. Vibrators 132 can be spaced equidistant from adjacent vibrators 132 by a distance of, for example, 0.75 meters. Vibrators 132 can be bass shakers that are connected in a plurality of parallel configurations 134, with a smaller plurality of vibrators 132 in series in each of the parallel configurations 134.

A vibration controller box 135 can connect the parallel configurations 134 to controller 102. Controller 102 can be configured to alter at least one of frequency, intensity, and timing of operation of each of the plurality of vibrators 132. By way of example only, during a breathing exercise, vibrations can be timed to generate a vibration wave toward user 50 when user 50 is inhaling, and generate a vibration wave away from user 50 when user 50 is exhaling.

Each vibrator 132 can be individually addressable by controller 102 to generate a desired vibration pattern, Timeline 104 determines a direction of actuation of each vibrator 132 to generate the vibration pattern. An intermediate interaction layer processes the desired direction and intensity for the matrix. In this configuration, timeline 104 does not necessary need to know the configuration of vibrators 132 in floor 130, but simply pass the direction of the vibration wave.

Optionally, dampeners (not shown) can be provided where floor 130 of platform 100 meets floor 60 to avoid or reduce resonance from vibrations being reflected from floor 60.

Figure 8:
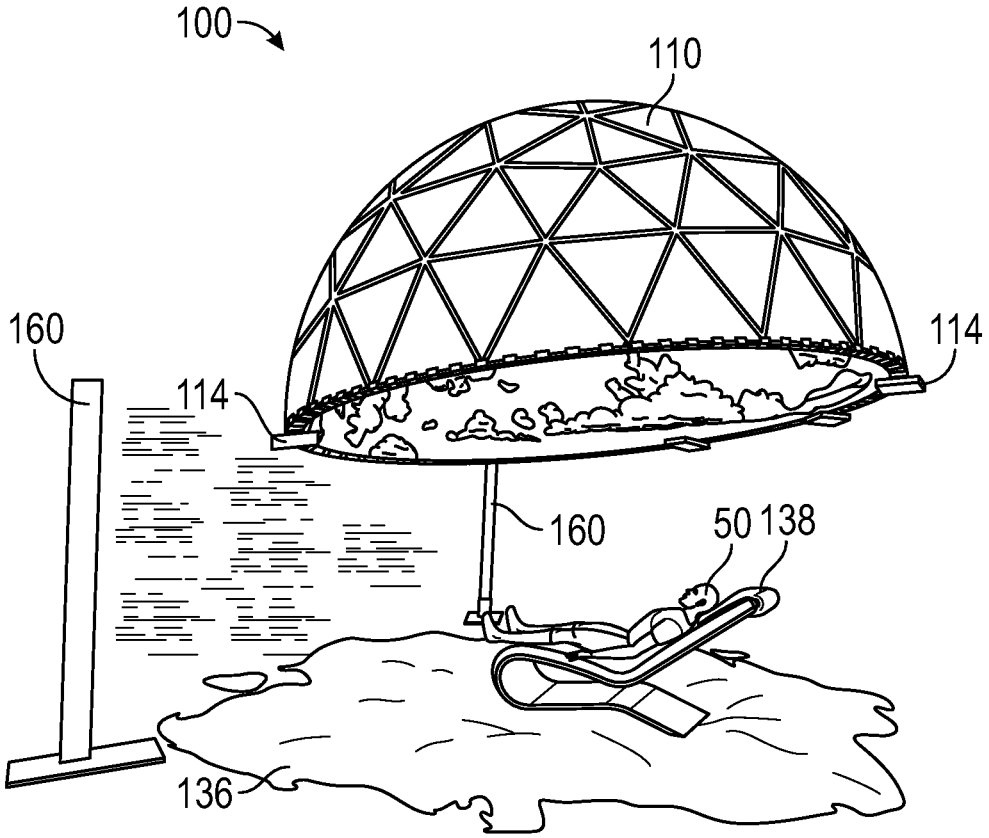
FIG. 8 is a perspective view of another alternative embodiment of an immersion platform according to the present invention.
Figure 8A:
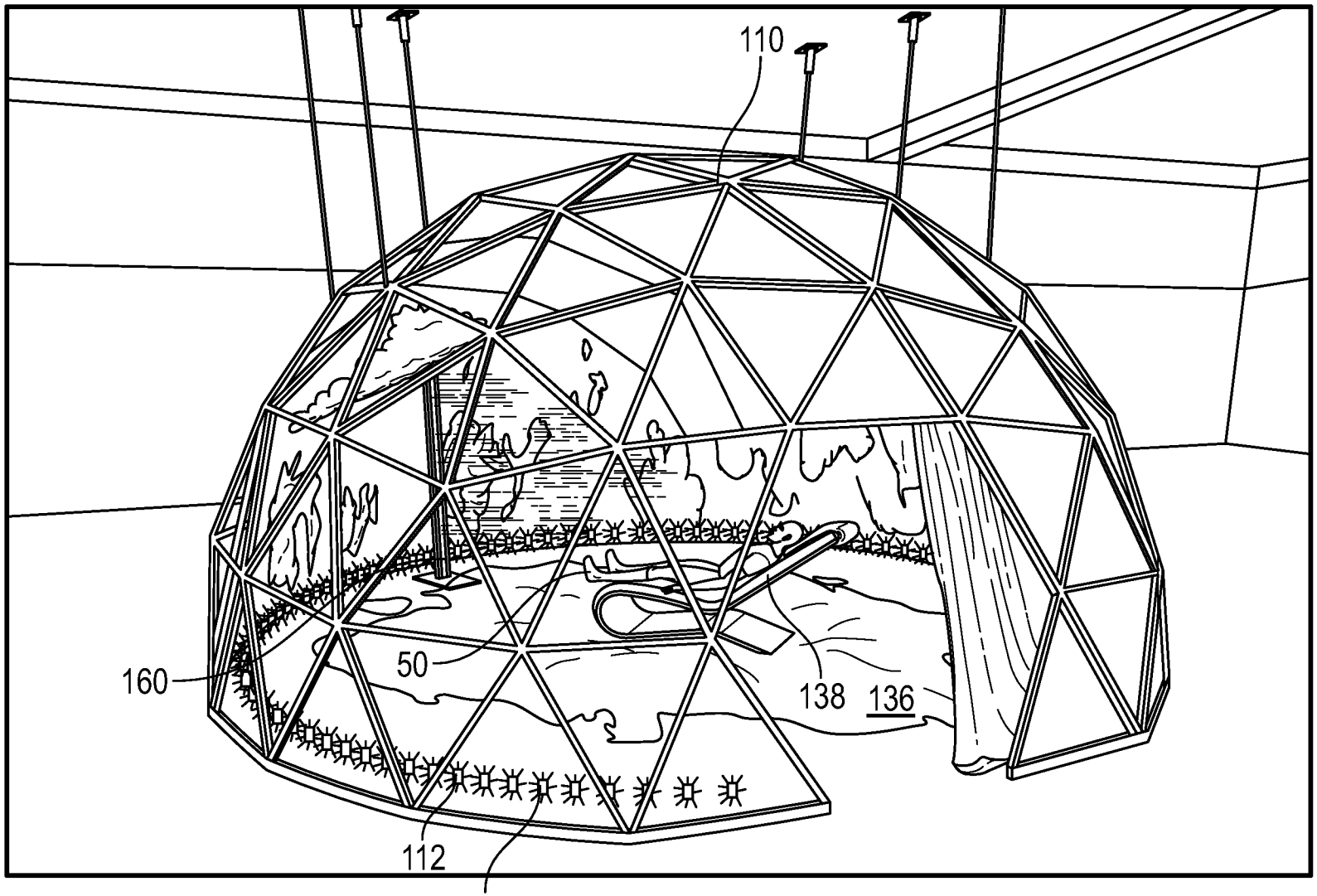
FIG. 8A shows a cut-away perspective view of the dome of FIG. 8 fully lowered to the floor.
Figure 8B:
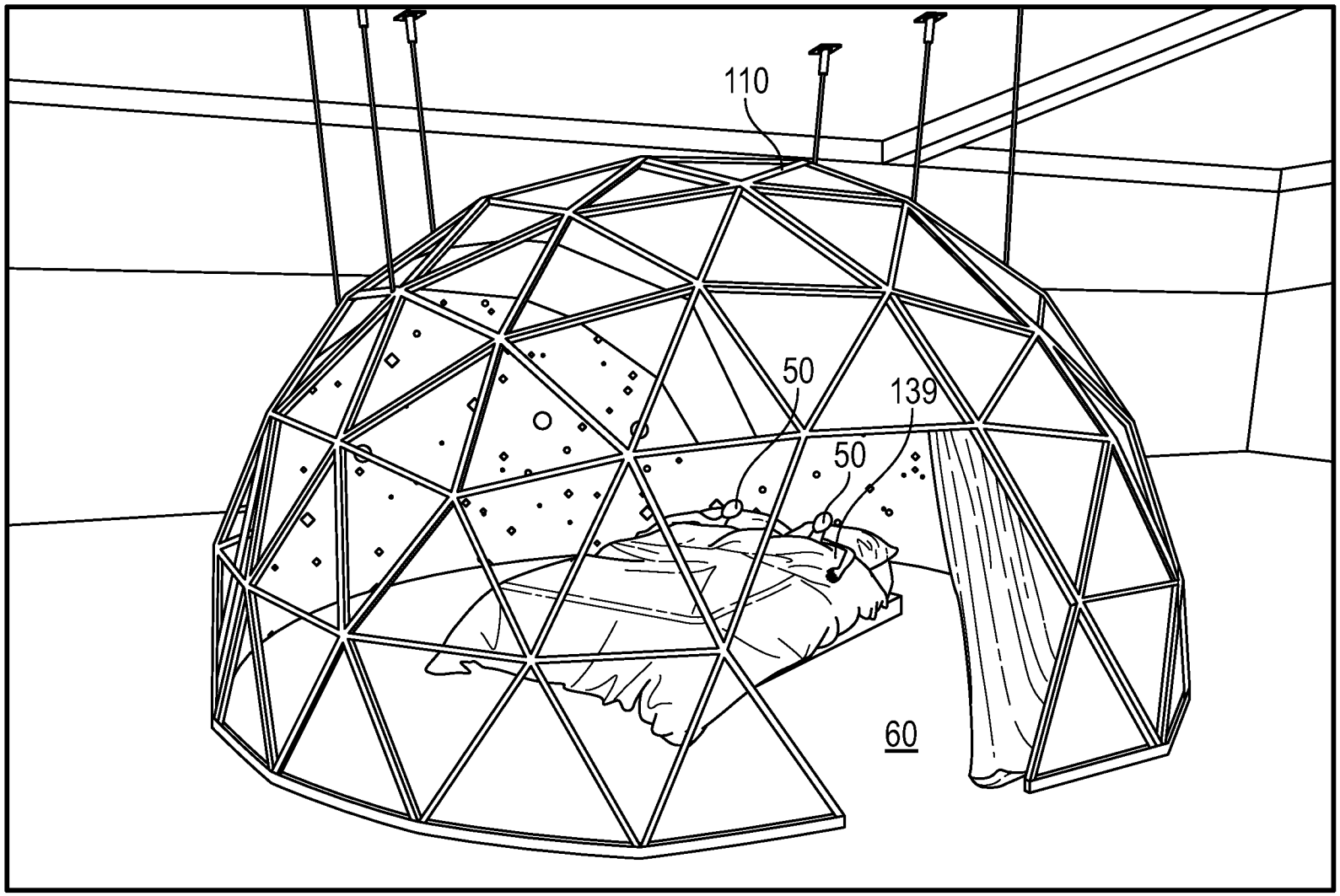
FIG. 8B shows a cut-away perspective view of the dome fully lowered to the floor with a bed inside the dome.

Optionally, floor 130 can be constructed from a natural material, such as bamboo, to link user 50 to a sense of nature while enabling a harder surface to perform workout activities such as hot yoga. With integrated floor haptics, a bamboo floor 130 extends the immersive capabilities of this configuration. Alternatively, instead of a solid floor 130, sand 136 can be used, as shown in FIGS. 8 and 8A, along with a beach chair 138, to simulate a beach environment. FIG. 8B shows dome 110 with a bed 139 inside and sitting directly on floor 60, with users 50 lying in bed 139.

Referring back to FIG. 1 an air blower module 140 can be provided to simulate wind along platform 100 or to just provide cooling air for user 50. A plurality of air blowers 140 can be spaced around the dome 110. Controller 102 is configured to control a volume of air from each of the plurality of air blowers 140 to simulate air blowing from a direction other than from one of the air blowers 140.

Figure 9:
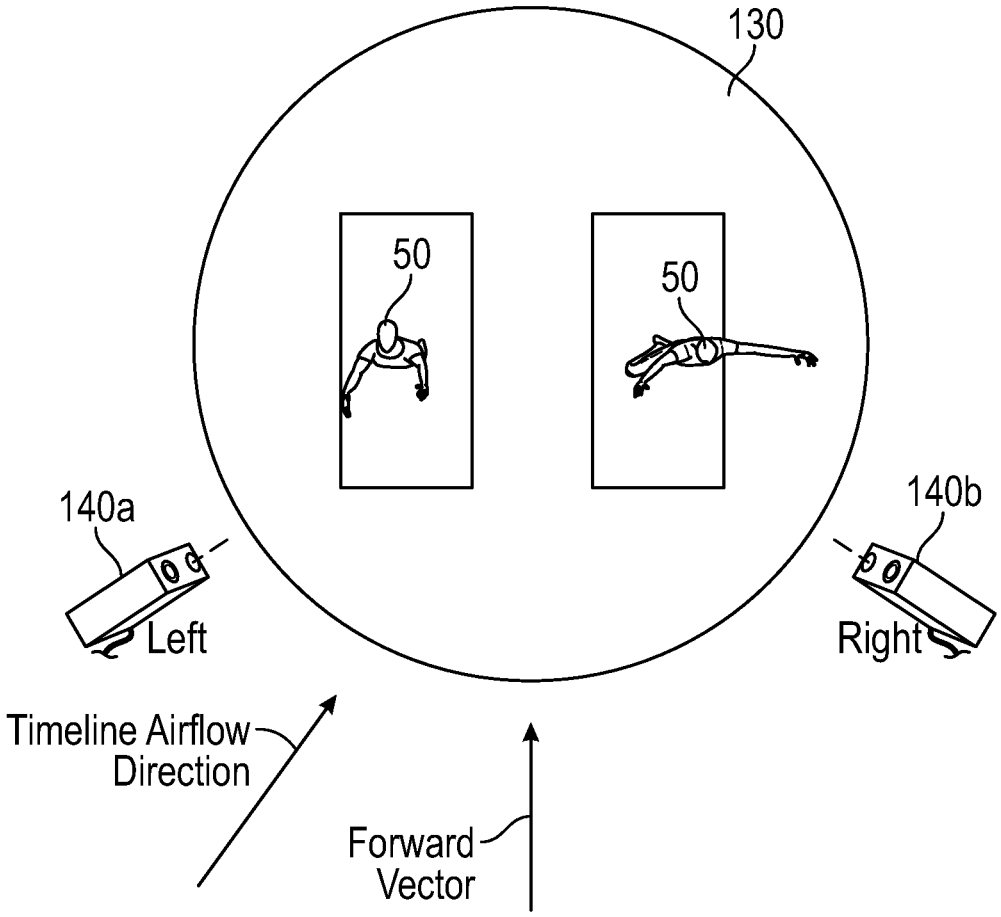
FIG. 9 is a top plan view of an arrangement of air blowers for use with any embodiment of the immersion platform according to the present invention.

FIG. 9 illustrates how air blowers 140*a*, 140*b* can be configured to simulate a flow of air from a direction between air blowers 140*a*, 140*b*. At a point on the timeline 104, the airflow can be at 50% of the potential maximum airflow and the airflow is incoming along the arrow marked "timeline airflow direction". That incoming airflow is at about 30 degrees from the forward vector. Using the above numbers, controller 102 calculates that the airflow from the left air blower 140*a* is about 40% and the airflow from the right air blower 140*b* is about 10% (based on angular difference between air modules 140*a*, 140*b* and the bias towards left, multiplied by the percentage of airflow set on the timeline 104).

Each of the plurality of air blowers 140 is directionally adjustable, and such adjustability can be operated via controller 102. In an exemplary embodiment, air blowers 140 can be adjusted +/− 15 degrees left/right and up/down. This feature can be beneficial in installations where floor space around floor 130 is limited or on raised/lowered surfaces.

Figure 10:
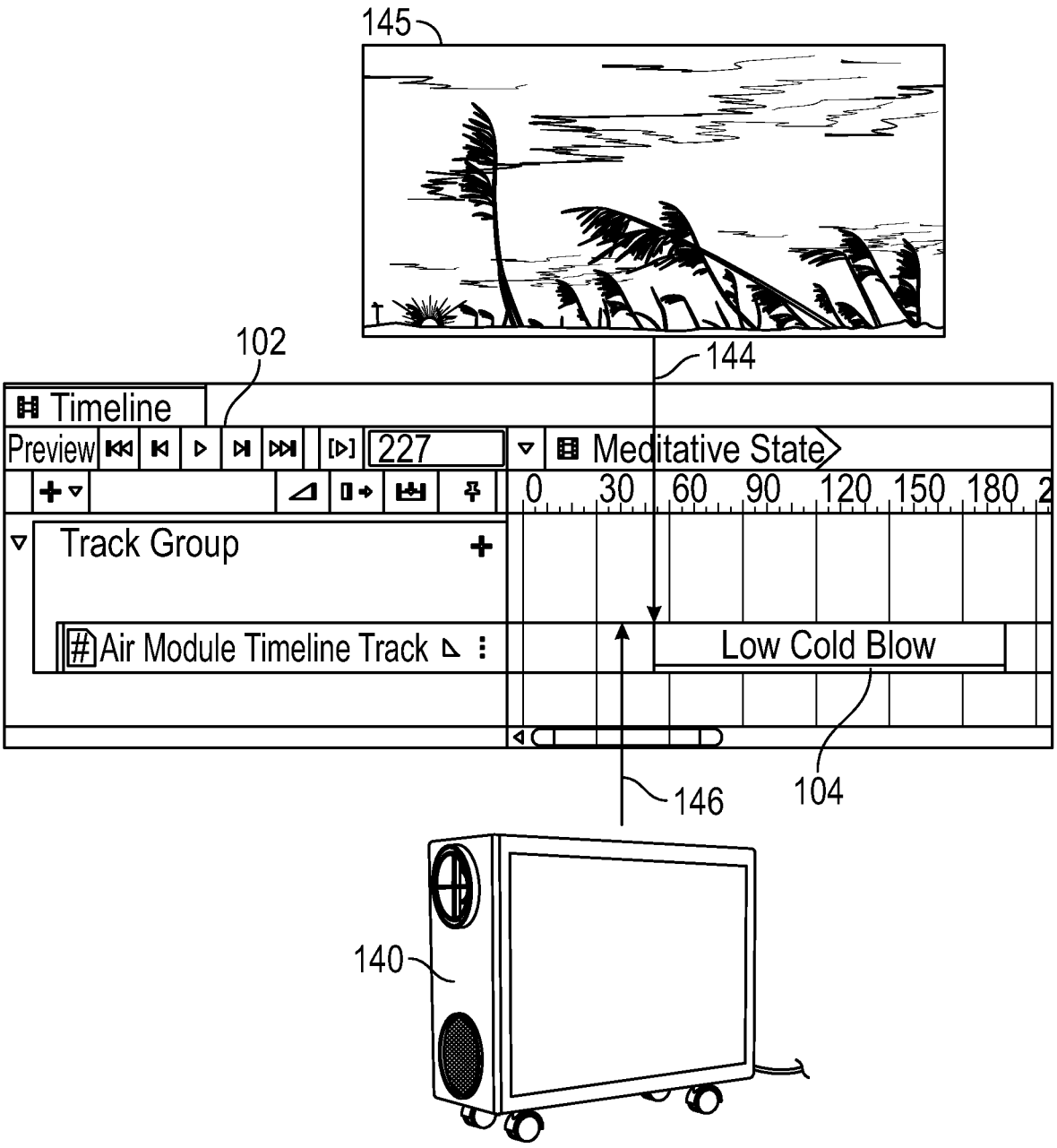
FIG. 10 is a schematic view of a configuration of the controller of FIG. 2 to control an air blower of FIG. 9.

Additionally, it is important to note that air unlike light and sound takes more time to cover a set distance so where the timeline editor specifies an incoming air flow the intermediate system based on the installation will look ahead in the timeline 104 to make up the airflow time to travel. An example of this would be a 1.5 meter diameter dome 110 having air blowers 140 look ahead a few seconds, whereas a larger 5 meter dome may need many more seconds of lead time. Illustrated in a timeline 104 of FIG. 10, is a time in the video (upper arrow 144) when a breeze is blowing some grass identified in frame 145, we want to have air blower 140 simulate this by activating the right blower 140*b*. Controller 102 determines that it takes 15 seconds at the activated speed for the air to reach the middle of the volume where the users 50 are located, so controller 102 seeks ahead in the timeline (lower arrow 146) 15 seconds to activate air blower 140.

Modular directional air blowers 140 enable users 50 to experience a sense of presence by integrating with what they see on the display on dome 110. With modular air blowers 140 providing directional air flow inline with the visualization, users 50 are both immersed and kept cool during their workout.

Air blowers 140 must be sized to be able to push air from its location, typically outside the perimeter of floor 130 to the location of user 50 on floor 130, with enough force so that user 50 can comprehend a noticeable difference in air flow from one direction over another.

As an additional feature, air blowers 140 can be fitted with air filters, such as HEPA filters, to both prevent large particulate matter from entering the operational portions of air blower 140, and also to clean the ambient air to provide a healthier breathing environment for user 50. Still further, UV lights can be incorporated with air blowers 140 to sanitize the air prior to blowing the air toward user 50.

Figure 11:
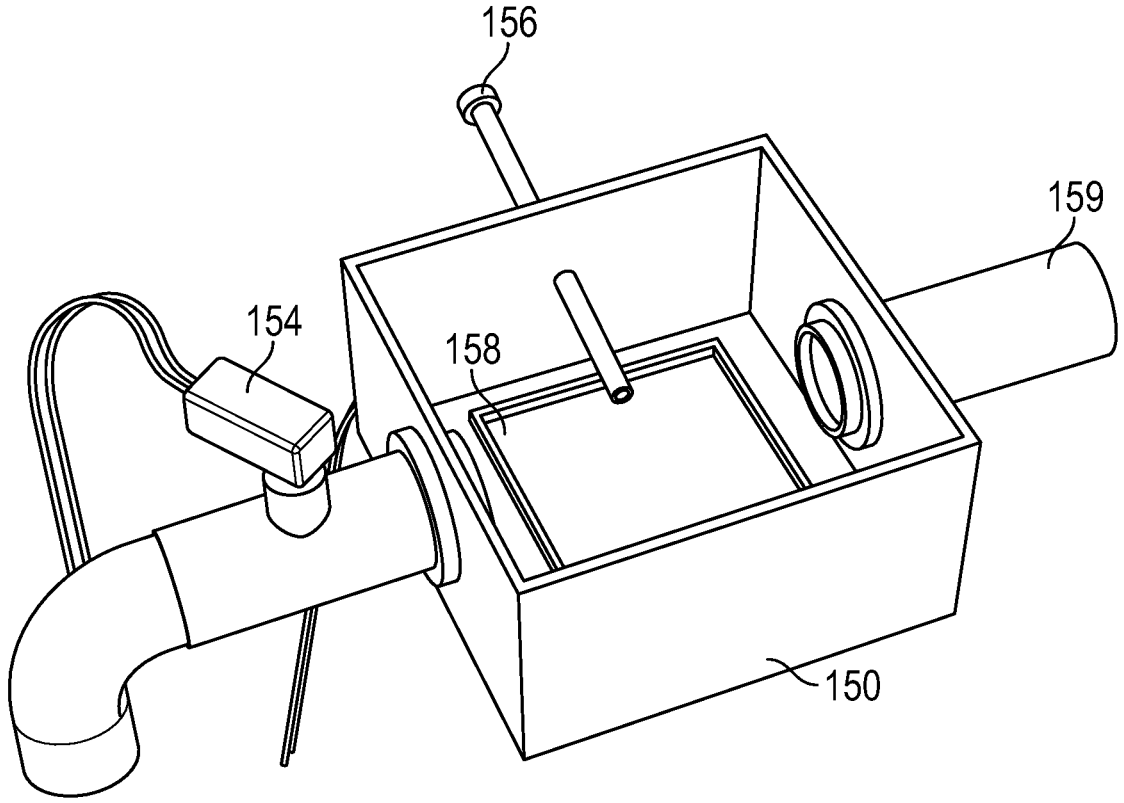
FIG. 11 is a perspective view of a scent generator for use with an air blower of FIG. 9.

Also, as shown in FIG. 11, a scent module 150 can be incorporated with air blower 140. Scent module includes an air inlet 152, an airway release valve 154 that is operated by controller 102 to control the flow of air through scent module 150, a scented oil feed 156 to introduce a scented oil to the air flow, a thermal pad 158 to generate heat within scent module 150 to infuse the scented oil into the airflow, and an air flow outlet 159 to allow the newly scented air to escape air blower 140.

Additionally, air generated by air blower 140 can be heated or cooled, depending on desires of user 50. Air blower 140 can include heating/cooling coils with hot or cold water flowing through to adjust the air temperature as desired. It is noted that warm air can still have a cooling effect on user 50 if blown quick enough due to evaporative cooling, where the skin's moisture with air flowing over the skin is evaporated, carrying away body heat.

Figure 12:
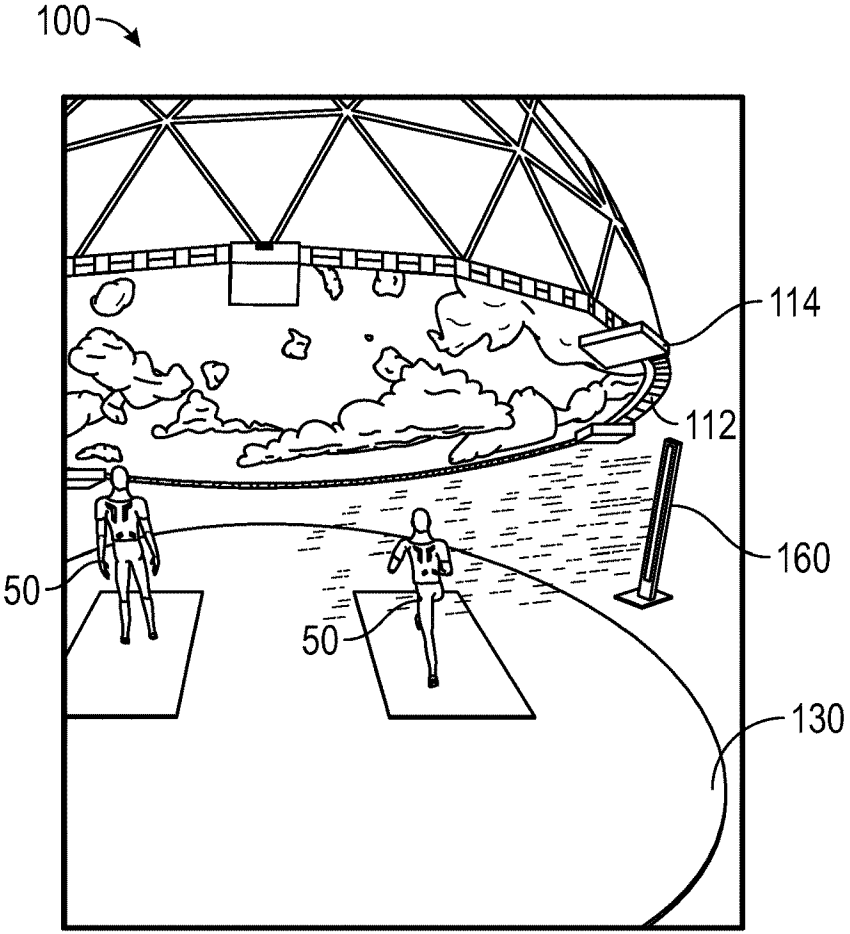
FIG. 12 is a perspective view of another alternative embodiment of an immersion platform according to the present invention.

Directional temperature during a session could be achieved by using a series of infrared heating elements 160 around the platform 100, as shown in FIG. 12. These heating elements 160 can be turned on and off to certain levels during a session in order to heat zones within the platform 100.

It should be noted that the efficiency of this method lowers as the overall volume temperature is raised (an example of this is having one side heat for a prolonged period of time, the other side is then turned on, but the effect on the user 50 is reduced as the starting temperature of the volume has increased).

Unlike other components like lighting, heating takes a longer time to take effect as a heating element 160 has to raise to temperature and then cross the distance to the user 50; obviously smaller volumes would see effects quicker. Speeding up this heating process could be done using an induction heating method. Using heating elements 160 is a "generalized" directional heating method, as the user 50 will feel heat from the equivalent of a quadrant (towards the front right or from the back left) as opposed to other hardware components used with platform 100 that have a tighter directionality. If the location that the platform 100 is installed in has Internet Of Things (IOT) enabled temperature control with a supported API, controller 102 can be configured to communicate with the ambient heating of the location to match with points on the timeline 104. Such heating would not be directional and as such heating element is not localized near the users 50, but would be more of a general temperature. For example, a meditation session with a hilltop visual could be cooler as opposed to a hot yoga session on with a beach visual with a warmer ambient temperature.

Figure 13:
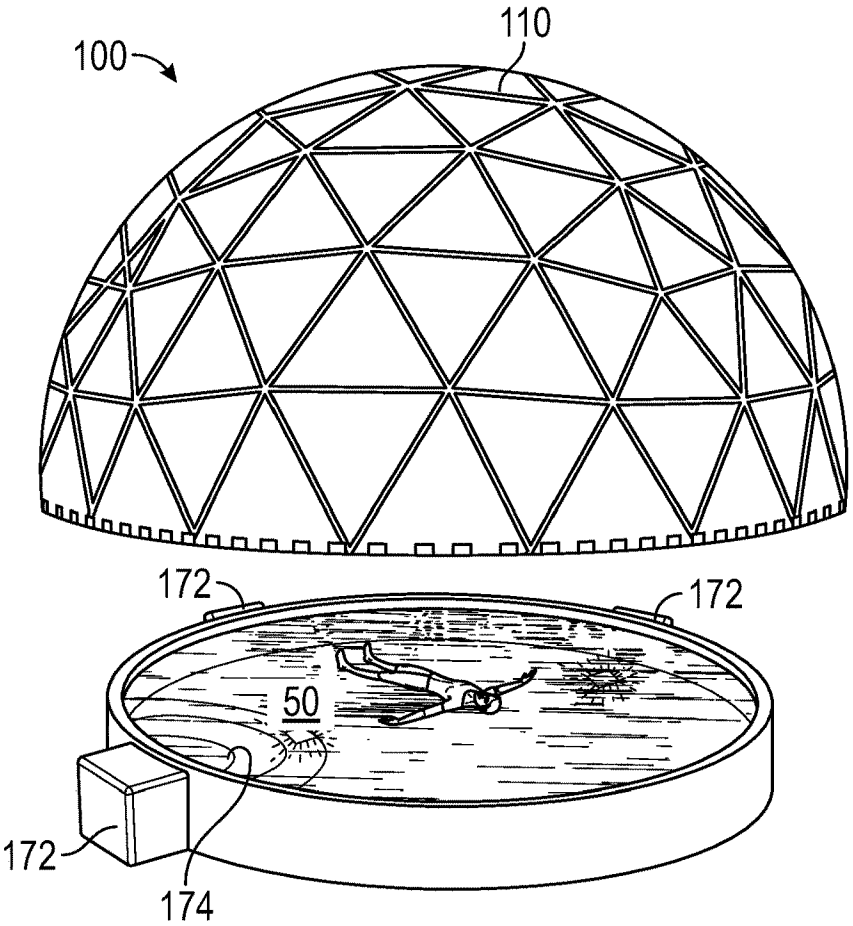
FIG. 13 is a perspective view of another alternative embodiment of an immersion platform according to the present invention.
Figure 13A:
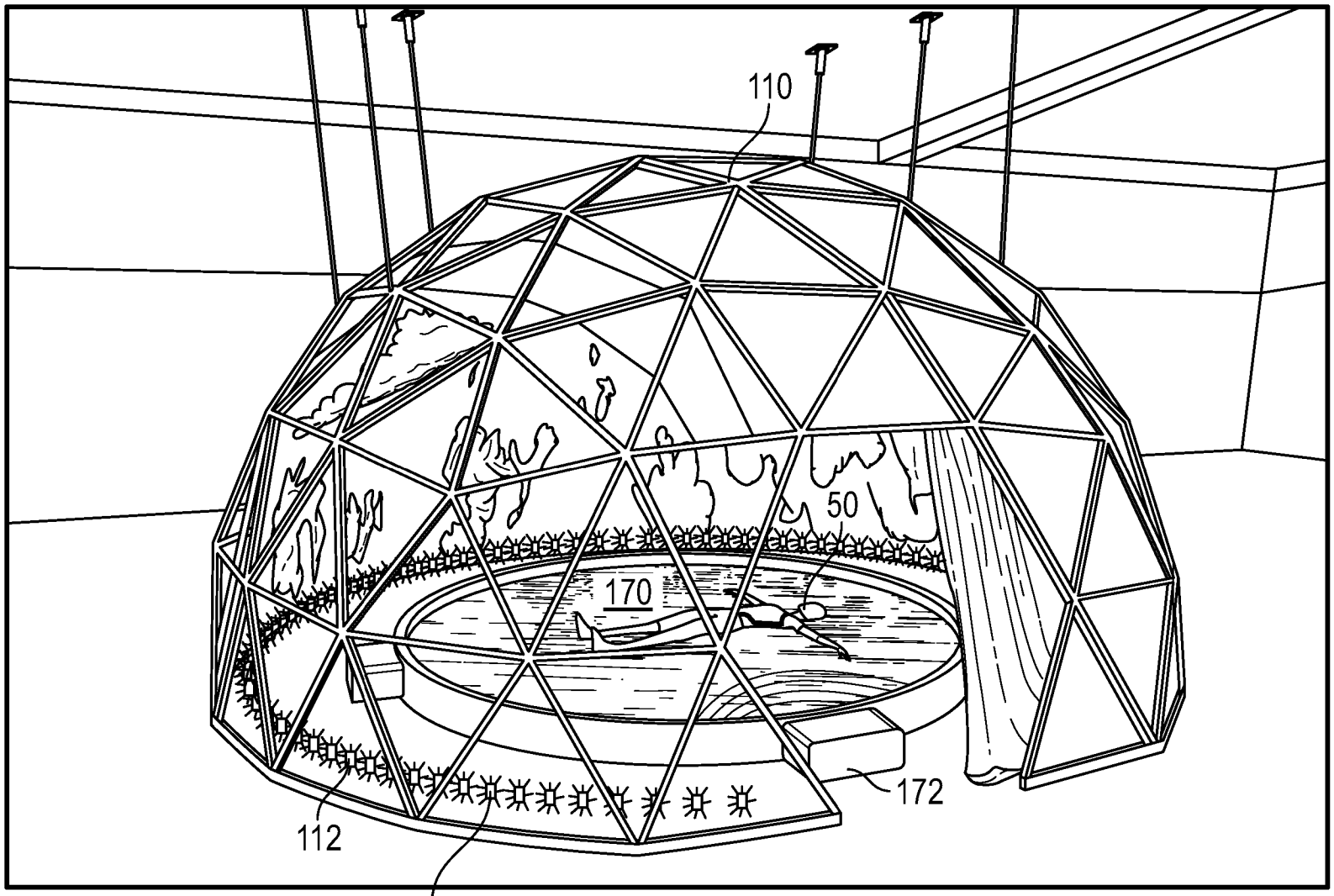
FIG. 13A shows a cut-away perspective view of the dome of FIG. 13 fully lowered to the floor.
Figure 14:
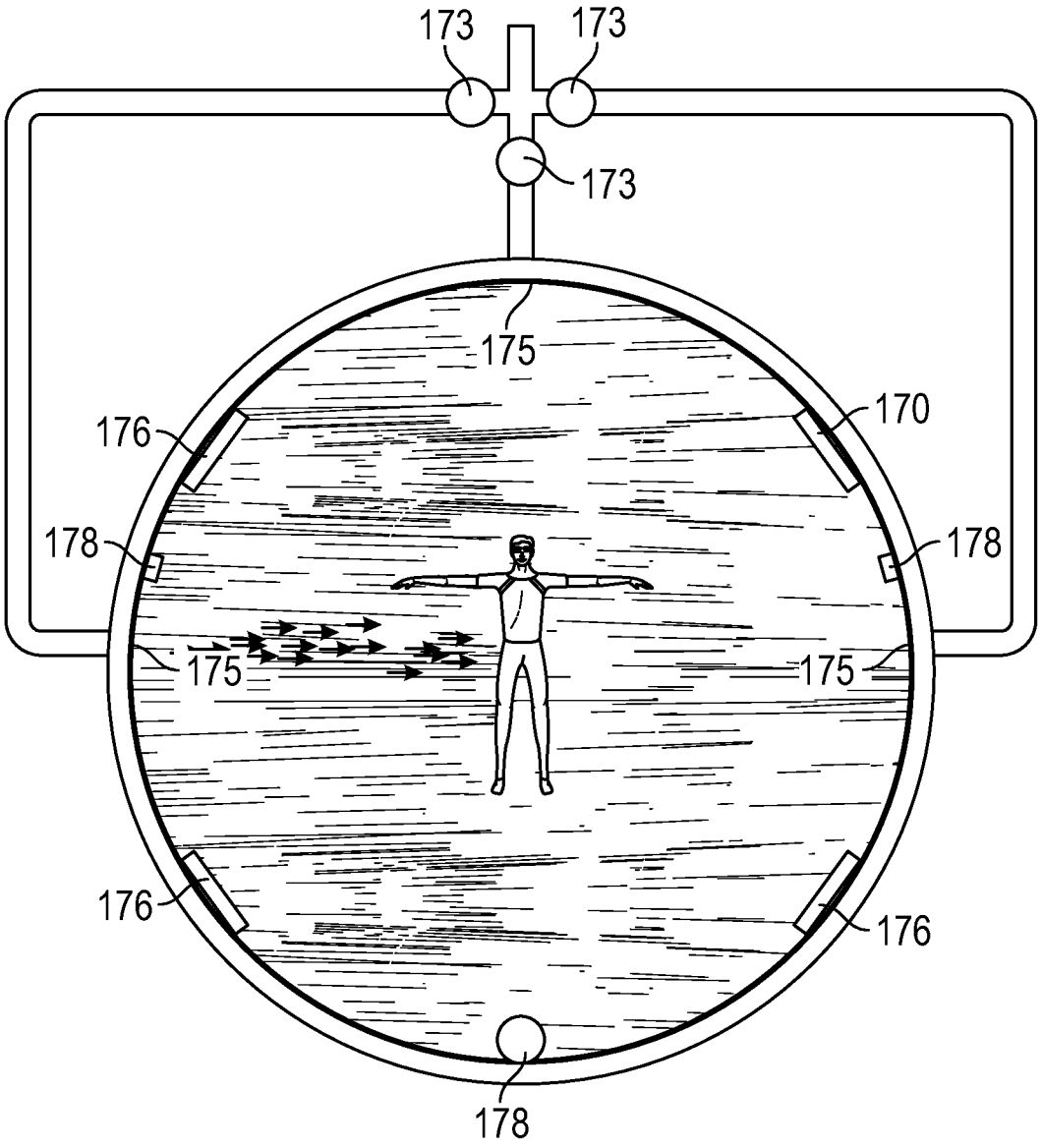
FIG. 14 is a top plan view of an immersion pool for use with an immersion platform according to the present invention.

Referring now to FIGS. 13, 13A, and 14, instead of providing a solid floor 130, a pool 170 can be placed beneath dome 110 for water immersion therapy. While the user 50 is suspended in the pool 170, the user 50 will be looking up into the dome 110, providing an almost infinity deep visual experience. The pool 170 illustrated in FIG. 13 can be just under 5 meters in diameter to fit within the perimeter of a 5 meter dome 110. In this configuration, pool 170 can fit up to two users 50.

A sense of motion can be induced in pool 170 using wave haptics. Within the pool 170, a haptic system is provided that moves the water around the user 50, giving the user 50 the impression of lying on a gently moving ocean surface or curling waves from the shallows of a beach.

In an exemplary embodiment, a pneumatic system can utilize pressurized air to move water within a chamber 172, producing waves 174. The strength of wave 174 can be determined based on the speed that chamber 172 is filled with air. This wave strength can be set by controller 102 within the timeline 104.

Alternatively, as shown in FIG. 14, directional wave haptics can be generated using off the shelf water jets placed 175 around the pool 170 and the addition of valves 173 to select which water jet is activated. With standard installation of pool water jets, it is common practice to point the jets so as to improve the circulation of water in the pool 170. This is to avoid dead areas where the water is stagnant and therefore not circulated regularly through the pool filter.

Using pool jets 175 to also create haptic interactions like this system requires either additional jets or ones which can be manually or automatically moved in order to still enable good water circulation in the pool. Water jet installations usually are fed from a single source after a filter and post the pumping system that is removing water from the pool. In this water haptic solution, valves 173 are provided between the filter and the jets 175 in order to select which jets 173 are active and by how much at any one time.

Three to eight jets 175 increasing granularity of directional haptics with increased number of water jets 175. A three-jet system would incorporate a front jet and two side jets 175 at 90°, as shown in FIG. 14, while an eight-jet system would establish a water jet 175 at 45° intervals. Consideration on the number of water jets 175 should take into account the directionality of the sessions to be played. For example, a beach scene may suffice from the lower 3 jets 175 with the feeling of water coming towards the user 50 and around their sides. However, a session where the water spirals around the user 50 would benefit from a surrounding system with 4 to 8 jets 175.

Chamber 172 can generate top waves or underwater waves, as shown in FIGS. 13 and 14, respectively. Controller 102 can be configured to alter the timing of operation of each of the plurality of underwater and top wave generators.

Sound from speakers 114, 120 is reproduced above the water line and additional sound from pool mounted speakers 176 can be located along the sides of pool 170, under the water, synchronized by controller 102 with speakers 114, 120 so as to not break the audio experience while the users ears bob above and below the water line.

Lights 178 can also be added within the pool 170 to immerse the user 50 further.

In an alternative configuration, dome 110 is not included but, instead, user 50 is provided a virtual reality headset or goggles. In a float spa base option, eyewear would be waterproof or hanging from a ceiling mount.

As shown in FIGS. 15-18, telepresence can be provided to simulate alternative environments. A camera 180 is positioned on the rim of the dome 110 in front of user 50 and enables user 50 to stream himself/herself to others using platform 100. Camera 180 can include a wide-angle lens for adequate capture capability. While a skirt 111 is not shown with dome 110 in FIG. 15, if a skirt 111 is used, a small hole must be provided at the interface between dome 110 and skirt 111 to allow the lens of camera 180 to protrude therethrough and not be obscured.

Camera 180 is electronically connected to controller 102 to capture the view seen by camera 180. Camera 180 records its view and, when projected onto another dome (and skirt) via controller 102, user 50 appears as an overlay on the visual that a second user at the other dome is experiencing. As user 50 moves, their projection is mapped onto the other dome to avoid image warping on the projected medium. An operator can use capture software at controller 102 linked to camera 180 to zoom and frame user 50.

Figure 16:
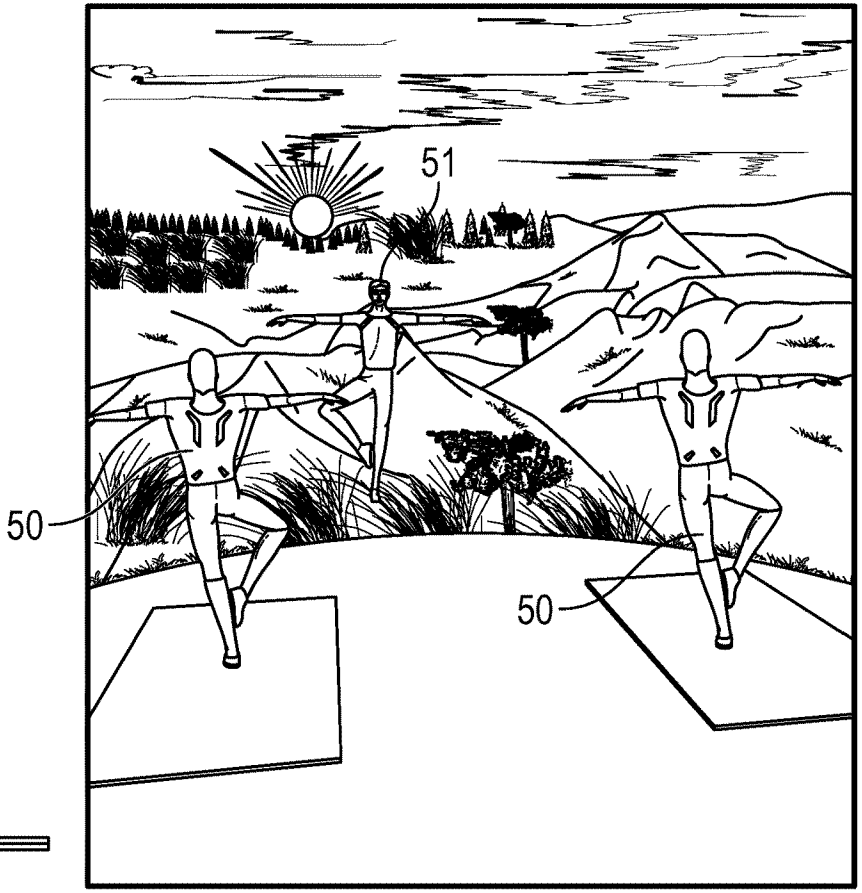
FIG. 16 is a front elevational view of a projection of a third party on the dome of the platform according to the present invention.
Figure 15:
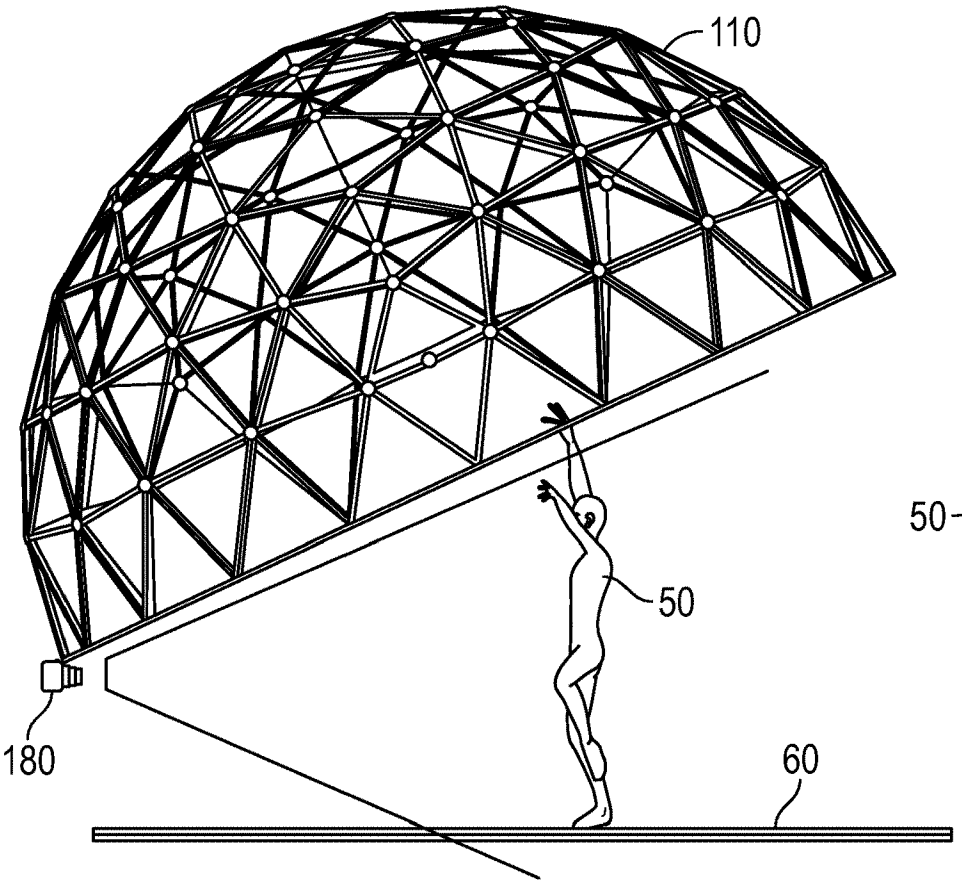
FIG. 15 is a schematic view of a camera with the immersion platform according to the present invention.

An example usage, shown in FIG. 16, can be a yoga instructor 51 teaching a class of students 50, 50' remotely or a presenter instructing an audience. This stream could be broadcast onto a non-platform display (such as a laptop or a television, not shown) and the instructor 51 is not required to be at a platform 100 for capture; instructor 51 can be remote with a camera 180 to stream.

Figure 17B:
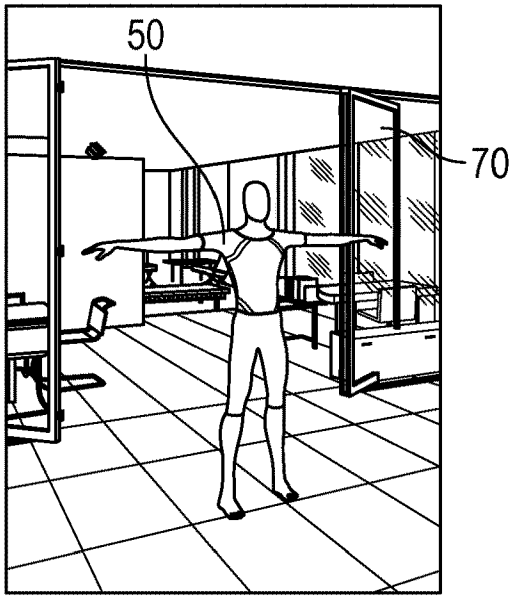
FIG. 17B is a perspective view of the user of FIG. 17A superimposed on the background of FIG. 17.
Figure 17A:
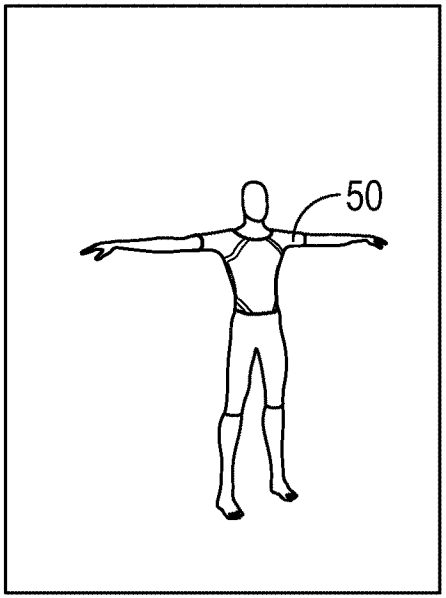
FIG. 17A is a perspective view of a user in a green screen environment.
Figure 17:
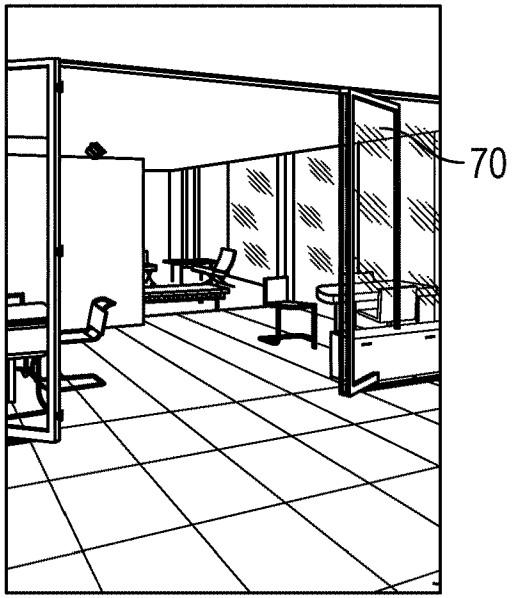
FIG. 17 is a perspective view of a background captured by the camera shown in FIG. 15.

Referring to FIGS. 17-17B, with the camera 180 focused from the front to the back of the platform 100, camera 180 will capture information 70 behind the user 50 (see FIG. 17). With current visual capture software, the background can be removed without using green screen style chroma key usage, as shown in FIG. 17A. However, a chroma key behind the user 50 may be required in order to perform a subtraction effect. This chroma key could use the well-lit background of the location of platform 100 or be applied as with the skirt 111 around the rim of the dome 110 covering the field of view from the camera 180.

User 50 can choose to have an overlay of their own visual showing user 50 in a picture and picture view much like many of today's video conferencing applications. This way user 50 can adjust their position, posture, etc. for better aesthetics for the viewers.

Using volumetric captured subjects transposed into virtual worlds, platform 100 can create more realistic displays of instructors 51 or other users 50 (captured subject) onto the platform 100. Operators on the fly can change the angle and distance of the camera 180 in the virtual world to frame the captured subject, for example emphasizing parts to the technique of a yoga pose.

Figure 18:
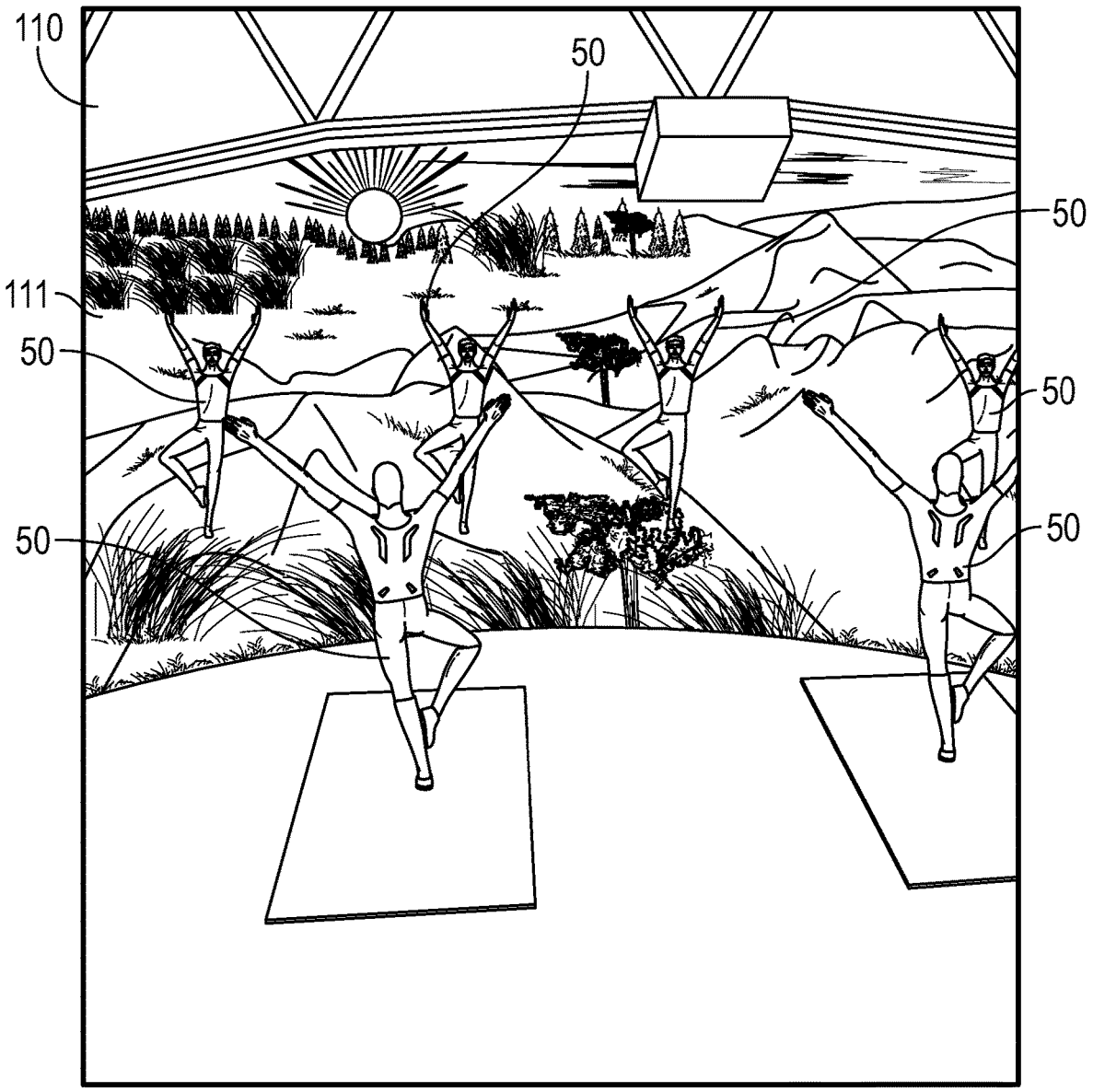
FIG. 18 is a perspective view showing a plurality of users displayed simultaneously on a skirt of a platform according to the present invention.

Volumetric capture as opposed to the streamed capture overlay described previously can provide a more realistic experience with the capture subject (user 50) as the subject can be placed and lit correctly in correlation to the virtual world in which the subject is being displayed. Volumetric capture uses devices such as a pair of cameras using a stereoscopic rig, an array of cameras around the rim, and/or a mixture of depth cameras and RGB cameras. These cameras capture the subject and, using software, abstract the background. The subject's 3D capture is then placed within the virtual world, as shown in FIG. 18.

Lights within the virtual world can then light the subject correctly and cast shadows from the subject onto virtual surfaces. The result can then be captured and displayed onto a medium such as the dome 110 or skirt 111. In addition to the ability to stream, a collaborate functionality is provided where many platforms 100 see each other within the dome projection, as shown in FIG. 18.

Such a feature can be considered to be as a joint collaborative session across multiple platforms 100. As more platforms 100 are added, the system software maps the overlay to a configured location upon the projection on dome 110 or skirt 111. The limiting factor is the scale of the overlaid projection on the dome 110 or skirt 111 to incorporate all of the other overlays. FIG. 18 shows several other users 50 collaborating with two users 50 at the location of platform 100.

Platform 100 requires the ability to connect across a network in order to receive the streamed sessions from other locations. The interface requires a lobby-based system where groups of platforms 100 connect in an on-line room at a set time in order to initiate the collaborative session. For the visual aspect, projectors 103, 105, 107 are fed a combined visual solution of both the base visualizations and any overlays from other platforms 100 connected across the network. Instructors 51 and other users 50 will need to be able to relay voice to other platforms for synchronicity and for any session material. They will also need to be able to start the visuals and any session audio so all locations are synchronized.

Platform 100 also allows for combining new brain stimulation and biofeedback programs within any of the embodiments described above in controller 102 to enhance meditation and induce desired mental states, address neuropsychiatric disorders, and assist with motor skills rehabilitation. Possible modalities can include:

Magnetic Stimulation, such as Transcranial Magnetic Stimulation (TMS) or Low Field Magnetic Stimulation (LFMS);

Electrical Stimulation, such as any one or more of Vagus Nerve Stimulation, Deep Brain Stimulation, Transcranial Direct Current Stimulation (tDCS), Transcranial Alternating Current Stimulation (tACS), Transcranial Random Noise Stimulation (tRCS);

Electromagnetic Radiation, such as Optogenetics or Near-Infrared Stimulation; and Ultrasound, such as Low Intensity Focused Ultrasound (LIFUP). Neurofeedback, such as Quantitative EEG (QEEG), High Performance Neurofeedback (HPN), Hemoencephalography (HEG), Alpha/Theta Neurofeedback (A/T), Beta Reset, Coherence.

Figure 20:
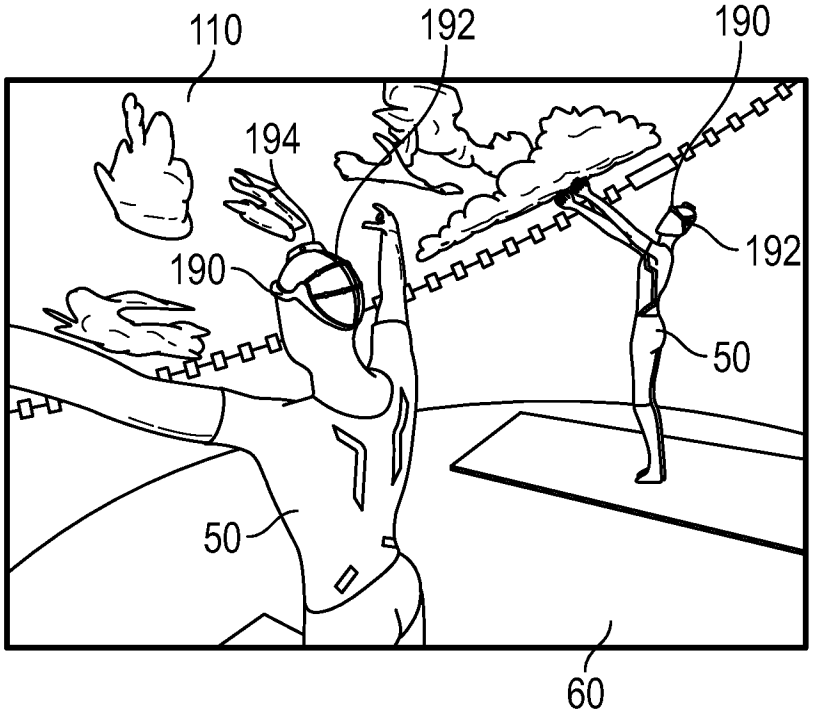
FIG. 20 is a rear perspective view of the exemplary brain stimulator of FIG. 19.
Figure 19:
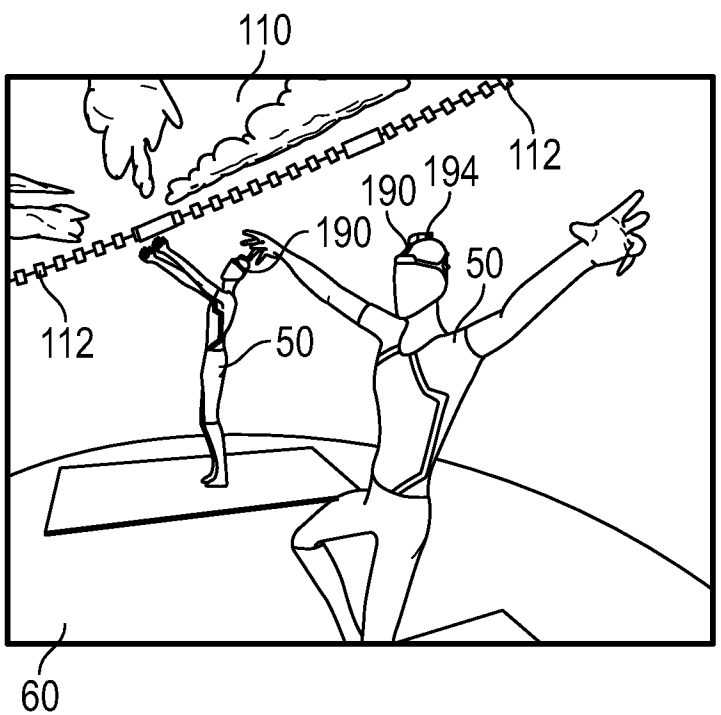
FIG. 19 is a front perspective view of an exemplary brain stimulator for use with the platform according to the present invention.

FIGS. 19 and 20 show an exemplary embodiment of a brain stimulator 190 that can be used to perform the brain stimulation described above. Brain stimulator 190 can include straps 192 to fit around the head of user 50, and a wireless transmitter/receiver 194 to wirelessly connect with controller 102. The wireless transmitter/receiver can be a Bluetooth® connection. The wireless connection is beneficial for user 50 who is active under dome 110. For a wireless brain stimulator 190, receiver/transmitter 194 is attached to straps 192 and affixed to the top of the head of user 50. Alternatively, brain stimulator 190 can be hardwired directly to controller 102, such as for meditation, where user 50 does not significantly move.

Platform 100 can be used for hospitality, such as in a hotel or spa with guest rooms that can include a 1-2 person configuration of the dome 110 and/or a large communal configuration for group experiential activity. An alternative version of the present platform 100 can be increased at a large scale to enable large group (dozens) use. Such a platform can be applied to group workouts with hard base floor and group float base versions. While enabling group participation, a larger platform 100 allows participants to affect the sensory experience or the video/audio content for all other participants.

Platform 100 can also be used for medical/therapeutic uses, particularly with pool 170 used as a float spa. In such an environment, platform 100 can be used for underwater and/or above water neurostimulation and neurofeedback via connected device for treatment of mental disorders, depression, anxiety, mediation assistance, general relaxation. Modalities can include rTMS (magnetic brain stimulation), weak electric field neurostimulation, TCDS (transcranial direct current stimulation), PEMF (pulsed electromagnetic field), and QEEG Neurofeedback.

It will be further understood that various changes in the details, materials, and arrangements of the parts which have been described and illustrated in order to explain the nature of this invention may be made by those skilled in the art without departing from the scope of the invention as expressed in the following claims.

We claim:

1. An immersion platform comprising:

a dome configured to display a predetermined scene, wherein the dome includes a projector and an outer perimeter;

a controller configured to display the predetermined scene on the dome from the projector and to activate a plurality of accessories according to a predetermined timeline; and a camera configured to allow a user to stream the user to other platforms while the user is using the platform, wherein the user appears as an overlay on a visual that a second user at another dome is experiencing.

2. The immersion platform according to claim 1, wherein the user is projected as an overlay onto other predetermined scenes on the other platforms.

3. The immersion platform according to claim 1, wherein the projection of the user is mapped onto the other platforms to avoid image warping.

4. The immersion platform according to claim 1, further comprising a brain stimulator configured for wireless transmission between the controller and the user.

5. The immersion platform according to claim 1, further comprising a brain stimulator configured to be worn by a user, wherein the brain stimulator enhances meditation and induce desired mental states, addresses neuropsychiatric disorders, and assists with motor skills rehabilitation in the user.

6. The immersion platform according to claim 5, wherein the program comprises magnetic stimulation, including Transcranial Magnetic Stimulation (TMS) or Low Field Magnetic Stimulation (LFMS).

7. The immersion platform according to claim 5, wherein the program comprises electrical stimulation, including any one or more of Vagus Nerve Stimulation, Deep Brain Stimulation, Transcranial Direct Current Stimulation (tDCS), Transcranial Alternating Current Stimulation (tACS), and Transcranial Random Noise Stimulation (tRCS).

8. The immersion platform according to claim 7, wherein the program comprises electromagnetic radiation, including Optogenetics or Near-Infrared Stimulation.

9. The immersion platform according to claim 5, wherein the program comprises ultrasound, including Low Intensity Focused Ultrasound (LIFUP).

10. The immersion platform according to claim 5, wherein the program comprises neurofeedback, including Quantitative EEG (QEEG), High Performance Neurofeedback (HPN), Hemoencephalography (HEG), Alpha/Theta Neurofeedback (A/T), Beta Reset, and Coherence.

11. The immersion platform according to claim 5, wherein the program comprises neurostimulation and neurofeedback for treatment of mental disorders, depression, anxiety, mediation assistance, general relaxation; modalities can include rTMS (magnetic brain stimulation), weak electric field neurostimulation, TCDS (transcranial direct current stimulation), PEMF (pulsed electromagnetic field), and QEEG Neurofeedback.

12. The immersion platform according to claim 1, wherein the camera comprises a pair of cameras configured to place a user in correlation to other predetermined scenes in which the user is being displayed.

13. The immersion platform according to claim 1, wherein the controller is configured to transmit voice from a first user to at the platform to a second user at a second platform, different from the platform.

14. An immersion platform comprising:

a dome configured to display a predetermined scene, wherein the dome includes an outer perimeter;

a controller configured to display the predetermined scene on the dome and to activate a plurality of accessories according to a predetermined timeline;

a water pool located beneath the dome; and a wave generator in the pool configured to generate waves in the pool, wherein the wave generator comprises:

a wave chamber; and a pneumatic system configured to use pressurized air to move water within the chamber.

15. The immersion platform according to claim 14, further comprising a brain stimulator configured to fit around the head of user and connected to the controller, wherein the brain stimulator is configured for underwater and/or above water neurostimulation and neurofeedback.

16. An immersion platform comprising:

a dome configured to display a predetermined scene, wherein the dome includes an outer perimeter;

a controller configured to display the predetermined scene on the dome and to activate a plurality of accessories according to a predetermined timeline; and a skirt located between the dome and a floor, wherein the scene is projectable onto the skirt.

17. The immersion platform according to claim 16, wherein the dome is not tilt-adjustable.

18. The immersion platform according to claim 16, further comprising a hole located at an interface between the dome and the skirt to allow a lens of a camera to protrude therethrough.

* * * * *